US011567448B2

(12) United States Patent
Yamamoto

(10) Patent No.: US 11,567,448 B2
(45) Date of Patent: Jan. 31, 2023

(54) CASSETTE DRAWING-IN DEVICE

(71) Applicant: TOSHIBA TEC KABUSHIKI KAISHA, Tokyo (JP)

(72) Inventor: Mikio Yamamoto, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/592,144

(22) Filed: Feb. 3, 2022

(65) Prior Publication Data

US 2022/0334534 A1 Oct. 20, 2022

(30) Foreign Application Priority Data

Apr. 15, 2021 (JP) ..... JP2021-069043

(51) Int. Cl.
*G03G 21/18* (2006.01)

(52) U.S. Cl.
CPC ..... *G03G 21/1842* (2013.01)

(58) Field of Classification Search
CPC ..... G03G 21/1842; G03G 21/1864; G03G 21/1871
See application file for complete search history.

(56) References Cited

U.S. PATENT DOCUMENTS 5,449,157 A * 9/1995 Kawano ..... G03G 15/6541 270/58.11
6,072,658 A * 6/2000 Kumagai ..... G11B 15/67557 360/96.51
8,428,506 B2 4/2013 Miki
10,126,702 B1 * 11/2018 Triplett ..... G03G 21/1647
10,331,077 B2 * 6/2019 Kusano ..... G03G 21/1864
11,377,315 B1 * 7/2022 Oshida ..... G03G 15/6502
11,400,738 B2 * 8/2022 Yamamoto ..... B65H 1/266
2008/0180764 A1 7/2008 Wakiyama et al.
2011/0031681 A1 2/2011 Miki
2013/0230335 A1 9/2013 Hiura et al.
2013/0285317 A1 10/2013 Ishikura
(Continued)

FOREIGN PATENT DOCUMENTS

EP 2144121 A2 1/2010
EP 2281764 A2 * 2/2011 ..... B65H 1/266
JP 2006036491 A 2/2006

OTHER PUBLICATIONS

Extended European Search Report dated Aug. 4, 2022, mailed in counterpart European Application No. 22162565.0, 5 pages.

*Primary Examiner* — Francis C Gray
(74) *Attorney, Agent, or Firm* — Kim & Stewart LLP

(57) ABSTRACT

A cassette drawing-in device includes a guide portion to guide a pin protruding from a paper feed cassette, a first member in which the guide portion is formed, a second member facing the first member, a first rotation shaft, a first link rotationally supported by the first rotation shaft, a second rotation shaft provided on the first link, a second link rotationally supported by the second rotation shaft and including an engagement groove which engages the pin and slides on the pin in a direction intersecting the moving direction of the pin, and a rib on one or both of the first member and the second member. The rib slides on a side surface of the second link within a range of movement of the second link that accompanies the rotation of the first link about the first rotation shaft.

20 Claims, 18 Drawing Sheets

(56) References Cited

U.S. PATENT DOCUMENTS

| | | | | |
|---|---|---|---|---|
| 2015/0185685 | A1 | 7/2015 | Takemoto et al. | |
| 2016/0231692 | A1 | 8/2016 | Hayayumi | |
| 2016/0363906 | A1 | 12/2016 | Yamamoto | |
| 2018/0329357 | A1* | 11/2018 | Triplett | G03G 21/1647 |
| 2019/0086852 | A1* | 3/2019 | Goto | B65H 1/266 |
| 2021/0253380 | A1* | 8/2021 | Oshida | G03G 21/1623 |

* cited by examiner

CASSETTE DRAWING-IN DEVICE

CROSS-REFERENCE TO RELATED APPLICATION

This application is based upon and claims the benefit of priority from Japanese Patent Application No. 2021-069043, filed Apr. 15, 2021, the entire contents of which are incorporated herein by reference.

FIELD

Embodiments described herein relate generally to a cassette drawing-in device.

BACKGROUND

A device for drawing in a paper feed cassette may be provided in a main body of an image forming apparatus or an image processing apparatus. Such a device may be referred to as a "cassette drawing-in device" and serves to reduce the insertion force required to be applied by the user when inserting a paper feed cassette.

The cassette drawing-in device includes a link linked to a pin provided on the paper feed cassette. The large resistance during moving of the link may cause the insertion force required from the user to be increased.

DETAILED DESCRIPTION

Figure 1:
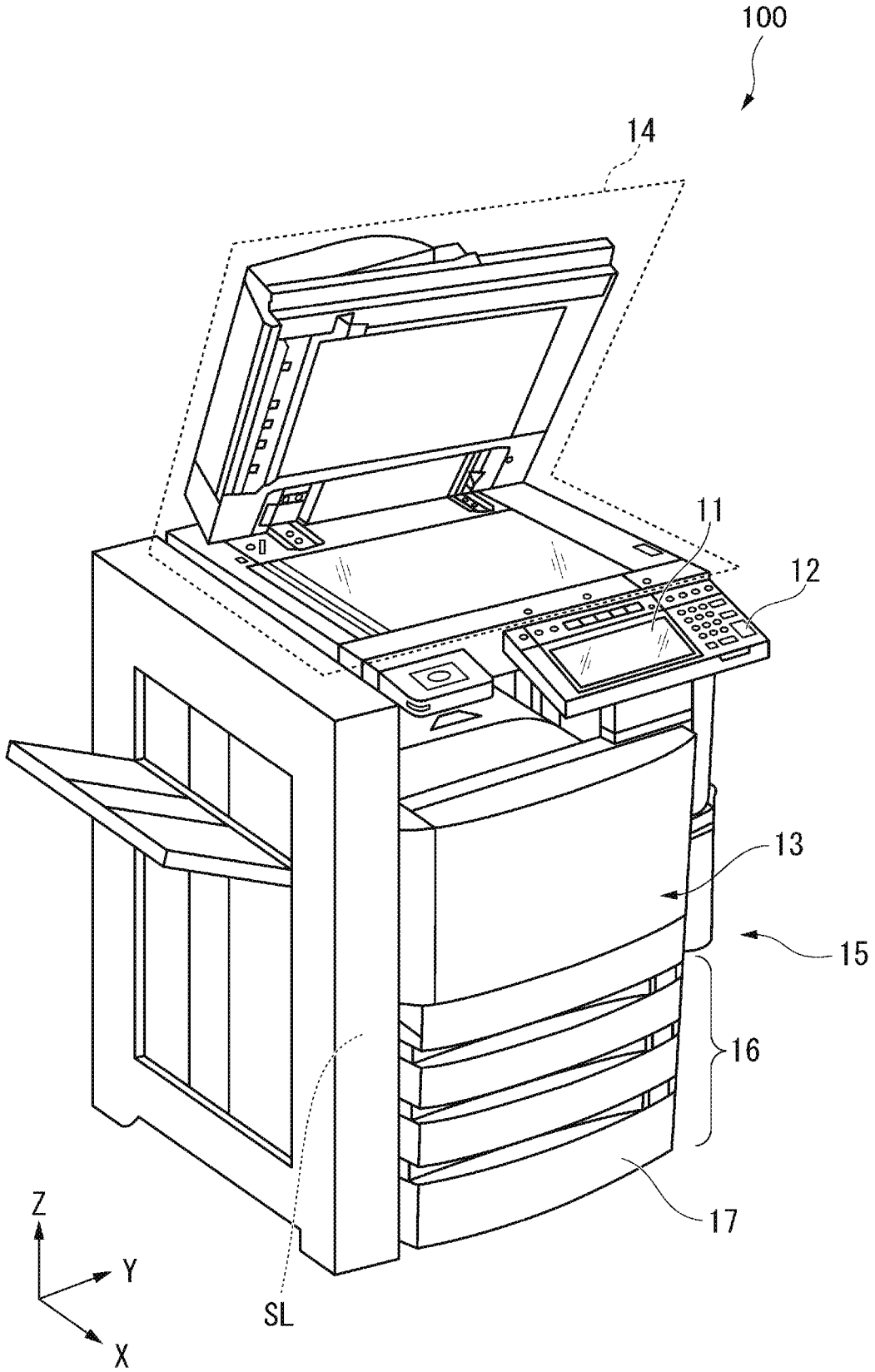
FIG. 1 is a schematic perspective view of an image processing apparatus according to an embodiment.

In general, according to one embodiment, there is provided a cassette drawing-in device capable of reducing an insertion load on a user an providing a smooth insertion of a paper feed cassette in an image forming apparatus, processing apparatus, or the like.

According to one embodiment, a cassette drawing-in device includes a first member. A guide portion is formed in the first member and is configured to accept a pin that protrudes from a paper feed cassette to be inserted and removed along a first direction. The pin protrudes from the paper feed cassette in a second direction orthogonal to the first direction. The guide portion positions the pin in a third direction orthogonal to the first direction and the second direction when the paper feed cassette is being inserted and removed. A second member is fixed to the first member and faces the first member in the first direction. A first rotation shaft is between the first member and the second member and has a length from the second member to the first member in the first direction. A first link is rotationally supported by the first rotation shaft. A second rotation shaft is on the first link with a length in a direction facing the first member in the first direction. A second link is rotationally supported by the second rotation shaft and includes an engagement groove which engages with the pin in the first direction and slides on the pin in a direction intersecting a moving direction of the pin. A rib is on at least one of the first member and the second member and protrudes in the first direction toward the second link. The rib slides on a side surface of the second link within a range of movement of the second link accompanying the rotation of the first link about the first rotation shaft.

Hereinafter, a cassette drawing-in device according to certain embodiments will be described with reference to the drawings. In the following drawings, unless otherwise specified, the same or corresponding configurations are designated by the same reference numerals.

FIG. 1 is a schematic perspective view illustrating an example of an image processing apparatus according to an embodiment.

The cassette drawing-in device of the embodiment can be provided in an image processing apparatus 100 illustrated in FIG. 1, for example.

The image processing apparatus 100 forms an image on paper. The image processing apparatus 100 may be an image forming apparatus such as a multifunction printer (MFP) printer, a copying machine, and the like, for example. The image processing apparatus 100 may perform image processing on the image formed on the paper. In this context, examples of image processing using the image processing apparatus 100 may include an erasing process involving heating an image on a sheet previously printed with a decolorable toner.

The image processing apparatus 100 includes a control panel unit 12, a display 11, an image forming unit 13, an image reading unit 14, an apparatus main body 15, and a paper accommodating unit 16.

The control panel unit 12 and the display 11 are used by a user to make user inputs for operating the image processing apparatus 100. The display 11 displays information related to user operations and/or messages to the user.

The image forming unit 13 forms an image on paper based on the user inputs or signals from an external device (external signals).

The image reading unit 14 reads (scans) a document and forms an image signal based on scanned document. The image reading unit may read (scan) an image formed by the image forming unit 13 on a sheet or the like.

The apparatus main body 15 is a housing that accommodates the display 11, the control panel unit 12, the image forming unit 13, the image reading unit 14, and the paper accommodating unit 16. An outer surface of the apparatus main body 15 is covered with a cover.

The paper accommodating unit 16 is arranged in a lower space SL of the apparatus main body 15. The paper accommodating unit 16 includes a paper feed cassette 17. In the example illustrated in FIG. 1, three separate paper feed cassettes 17 are provided. Each paper feed cassette 17 can be drawn out to the front side of the apparatus main body 15.

Hereinafter, the relative positions in the image processing apparatus 100 may be described with reference to the X-axis, Y-axis, and Z-axis illustrated in the drawings. The X-axis is an axis extending from the rear side to the front side of the image processing apparatus 100. The Y-axis is orthogonal to the X-axis in the horizontal plane. The Y-axis extends from the left side toward the right side of the image processing apparatus 100. The Z-axis is orthogonal to the X and Y axes. The Z-axis is a vertical line.

A direction along the X-axis is defined as the X-axis direction. In the X-axis direction, the direction from the rear side to the front side is the positive direction of the X-axis, and the direction from the front side to the rear side is the negative direction of the X-axis. In the Y-axis direction, the direction from the left side to the right side is the positive direction of the Y-axis, and the direction from the right side to the left side is the negative direction of the Y-axis. In the Z-axis direction, the direction from the lower side to the upper side is the positive direction of the Z-axis, and the direction from the upper side to the lower side is the negative direction of the Z-axis.

A plane having a normal in the X-axis direction is a Y-Z plane, a plane having a normal in the Y-axis direction is a Z-X plane, and a plane having a normal in the Z-axis direction is an X-Y plane. The X-Y plane is a horizontal plane.

Unless otherwise specified, the shape, positioning, and posture of the members, elements, aspects, and components in the image processing apparatus 100 will be described based on the position and posture of the image processing apparatus 100 depicted in FIG. 1.

Figure 2:
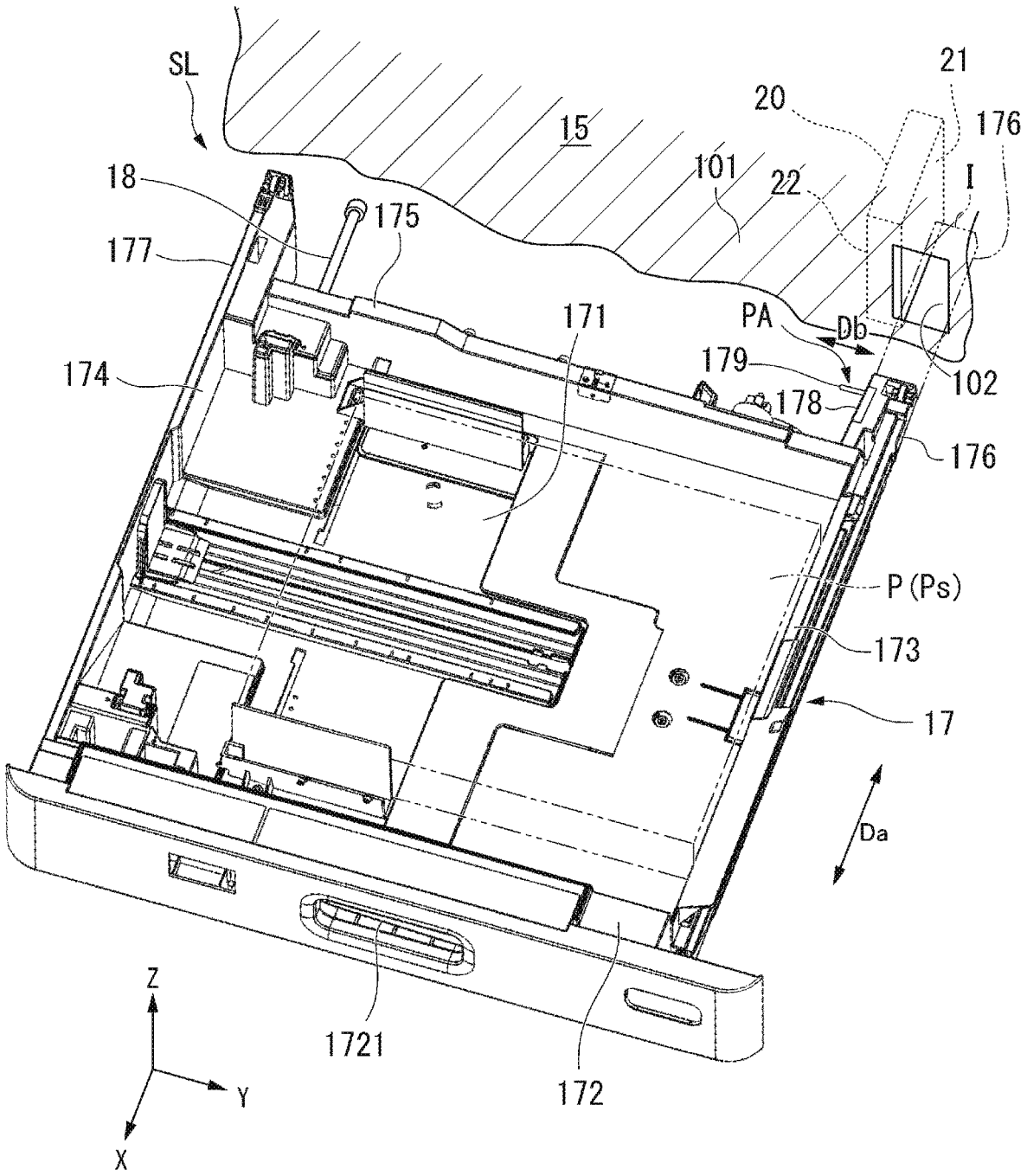
FIG. 2 is a schematic perspective view illustrating a paper feed cassette in an image processing apparatus.

FIG. 2 is a schematic perspective view illustrating a paper feed cassette 17 in the image processing apparatus.

The shapes of the paper feed cassettes 17 in the paper accommodating unit 16 are the same as each other. FIG. 2 illustrates one of the paper feed cassettes 17 forming the paper accommodating unit 16.

An inner plate 101 and a cassette drawing-in device 20 are arranged inside the rear side of the apparatus main body 15.

The inner plate 101 is parallel to the Y-Z plane. An introduction hole 102 is formed in the inner plate 101.

The introduction hole 102 penetrates the inner plate 101. For example, the shape of the introduction hole 102 is substantially rectangular when seen from the front side. The introduction hole 102 allows a portion of the paper feed cassette 17 to pass through when the paper feed cassette 17 is being inserted into the apparatus main body 15.

The paper feed cassette 17 has a general shape of a box that is open upward (e.g., an open top box). The paper feed cassette 17 includes a bottom plate 171, a front plate 172, a right side plate 173, a left side plate 174, and a rear plate 175.

The bottom plate 171 is a rectangular plate on which the paper P can be placed. The bottom plate 171 is arranged horizontally.

The front plate 172 protrudes upward along an end of the bottom plate 171 in the positive direction of the X-axis.

A handle 1721 for the user to grasp is provided in the central portion of the front plate 172.

The right side plate 173 protrudes upward along an end of the bottom plate 171 in the positive direction of the Y-axis.

The left side plate 174 protrudes upward along an end of the bottom plate 171 in the negative direction of the Y-axis.

The rear plate 175 protrudes upward along an end of the bottom plate 171 in the negative direction of the X-axis.

The possible (expected) position of paper P is indicated by an alternate long and short dash line in FIG. 2. The paper P is loaded on top of the bottom plate 171 from the vertical direction. A paper sheet bundle Ps (a stack of paper P), having a loading height lower than the protruding heights of the front plate 172, the right side plate 173, the left side plate 174, and the rear plate 175, can be placed in the paper feed cassette 17.

A right rear end beam 176 protrudes from a right end of the rear plate 175 in the negative direction of the X-axis. A left rear end beam 177 protrudes from a left end of the rear plate 175 in the negative direction of the X-axis.

The right rear end beam 176 and the left rear end beam 177 have a shape of a prism having a rectangular cross section parallel to the Y-Z plane, for example.

The right rear end beam 176 is formed in a size and position such that it can be inserted into the introduction hole 102.

At the left end of the rear plate 175, a damper 18 is provided near the left rear end beam 177. The damper 18 comes into contact with the inner plate 101 when the paper feed cassette 17 is inserted, and absorbs impacts during insertion.

The apparatus main body 15 has an insertion guide formed therein to support the left end and the right end of the paper feed cassette 17. The right rear end beam 176 and the left rear end beam 177 are inserted into the insertion guide provided in the apparatus main body 15 when the paper feed cassette 17 is being inserted into the apparatus main body 15.

Like the right rear end beam 176, a guide protrusion that can be moved along the insertion guide protrudes on a right side surface of the right side plate 173 in the positive direction of the Y-axis.

Like the left rear end beam 177, a guide protrusion that can be moved along the insertion guide protrudes on a left side surface of the left side plate 174 in the negative direction of the Y-axis.

The paper feed cassette 17 can be inserted into the apparatus main body 15 or drawn out from the apparatus main body 15 along the insertion guide in the apparatus main body 15 in a first direction Da along the X-axis. The first direction Da is an example of the insertion and removal direction in which the paper feed cassette 17 can be inserted and removed.

When the paper feed cassette 17 is inserted into the apparatus main body 15, the right rear end beam 176 is passed through the inside of the introduction hole 102 and is moved to a rear side of the inner plate 101.

A cassette side link 178 is provided at an end of the right rear end beam 176 in the negative direction of the Y-axis. The cassette side link 178 is rotatably supported by the right rear end beam 176 along the Z-X plane.

A pin 179 protruding from the cassette side link 178 in the negative direction of the Y-axis is provided at the end opposite to the end rotationally supported by the cassette side link 178.

The pin 179 is a drawing-in end PA that, when engaged with the cassette drawing-in device 20, applies a force for drawing in the paper feed cassette 17 from the cassette drawing-in device 20 in the negative direction of the X-axis.

The cassette side link 178 and the pin 179 are formed in a shape such that they can pass through the introduction hole 102 together with the right rear end beam 176.

When the paper feed cassette 17 is inserted into the apparatus main body 15 in the first direction Da, the cassette drawing-in device 20 draws in the paper feed cassette 17 through the drawing-in end PA in the negative direction of the X-axis.

The cassette drawing-in device 20 is arranged on the rear side of the inner plate 101. The position of the cassette drawing-in device 20 in the Y-axis direction is a position where a portion thereof in the positive direction of the Y-axis overlaps the inside of the introduction hole 102 when seen from the front side. However, the end of the cassette drawing-in device 20 in the positive direction of the Y-axis is arranged at a position that does not interfere with the right rear end beam 176 that advances and retreats into the introduction hole 102.

Figure 3:
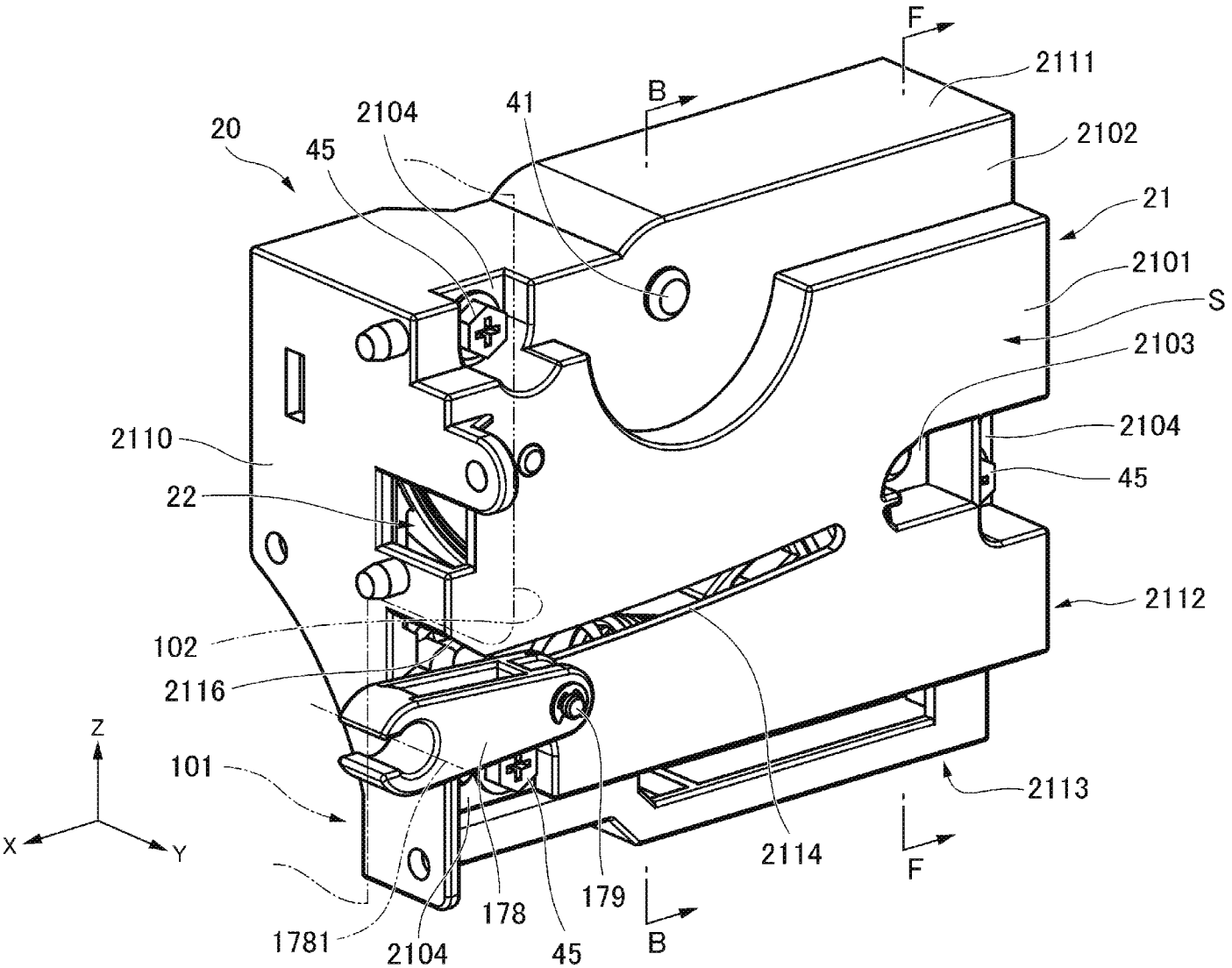
FIG. 3 is a schematic perspective view illustrating a cassette drawing-in device according to an embodiment.

FIG. 3 is a schematic perspective view illustrating an example of the cassette drawing-in device according to the embodiment.

As illustrated in FIG. 3, the cassette drawing-in device 20 has an outer shape that is substantially a rectangular parallelepiped shape narrow in the Y-axis direction. The cassette drawing-in device 20 includes a first member 21 and a second member 22.

The first member 21 is a cover that covers the second member 22 from the right side. The first member 21 has a shape of a box that is open in the negative direction of the Y-axis.

The first member 21 includes a surface portion S, a front side plate 2110, an upper side plate 2111, a rear side plate 2112, and a lower side plate 2113.

The surface portion S forms the surface of the first member 21 in the positive direction of the Y-axis. When seen from the negative direction of the Y-axis, the outer shape of the surface portion S is substantially rectangular.

The surface portion S includes a plurality of plate surface portions parallel to the Z-X plane and having different positions in the Y-axis direction. Plate surface portions adjacent to each other in the X-axis direction or the Z-axis direction and having different positions in the Y-axis direction are connected to each other by step portions having a length in the Y-axis direction.

In the example illustrated in FIG. 3, the surface portion S includes a first plate surface portion 2101, a second plate surface portion 2102, a third plate surface portion 2103, and a plurality of screw fastening portions 2104.

The first plate surface portion 2101 is a plate surface portion on the surface portion S that is extreme end in the positive direction of the Y-axis. The first plate surface portion 2101 faces a side surface of the right rear end beam 176 (see FIG. 2) when inserted into the introduction hole 102.

The second plate surface portion 2102 is formed at a position recessed in the negative direction of the Y-axis with respect to the first plate surface portion 2101 on the upper end side of the first plate surface portion 2101.

The third plate surface portion 2103 is formed at a position recessed in the negative direction of the Y-axis at the end of the first plate surface portion 2101 in the negative direction of the X-axis.

The plurality of screw fastening portions 2104 are plate surfaces for screw fastening the first member 21 to the second member 22 with screws 45. In the example illustrated in FIG. 3, the plurality of screw fastening portions 2104 are provided at three positions on the surface portion S, which are an upper end and a lower end of an end in the positive direction of the X-axis, and an end in the negative direction of the X-axis.

The front side plate 2110, the upper side plate 2111, the rear side plate 2112, and the lower side plate 2113 protrude in the negative direction of the Y-axis from outer peripheral portions of the front side, the upper side, the rear side, and the lower side of the surface portion S, respectively. The front side plate 2110, the upper side plate 2111, the rear side plate 2112, and the lower side plate 2113 cover the outer peripheral portion of the second member 22.

The front side plate 2110 is fixed with the inner plate 101 while contacting the rear surface of the inner plate 101.

Figure 4:
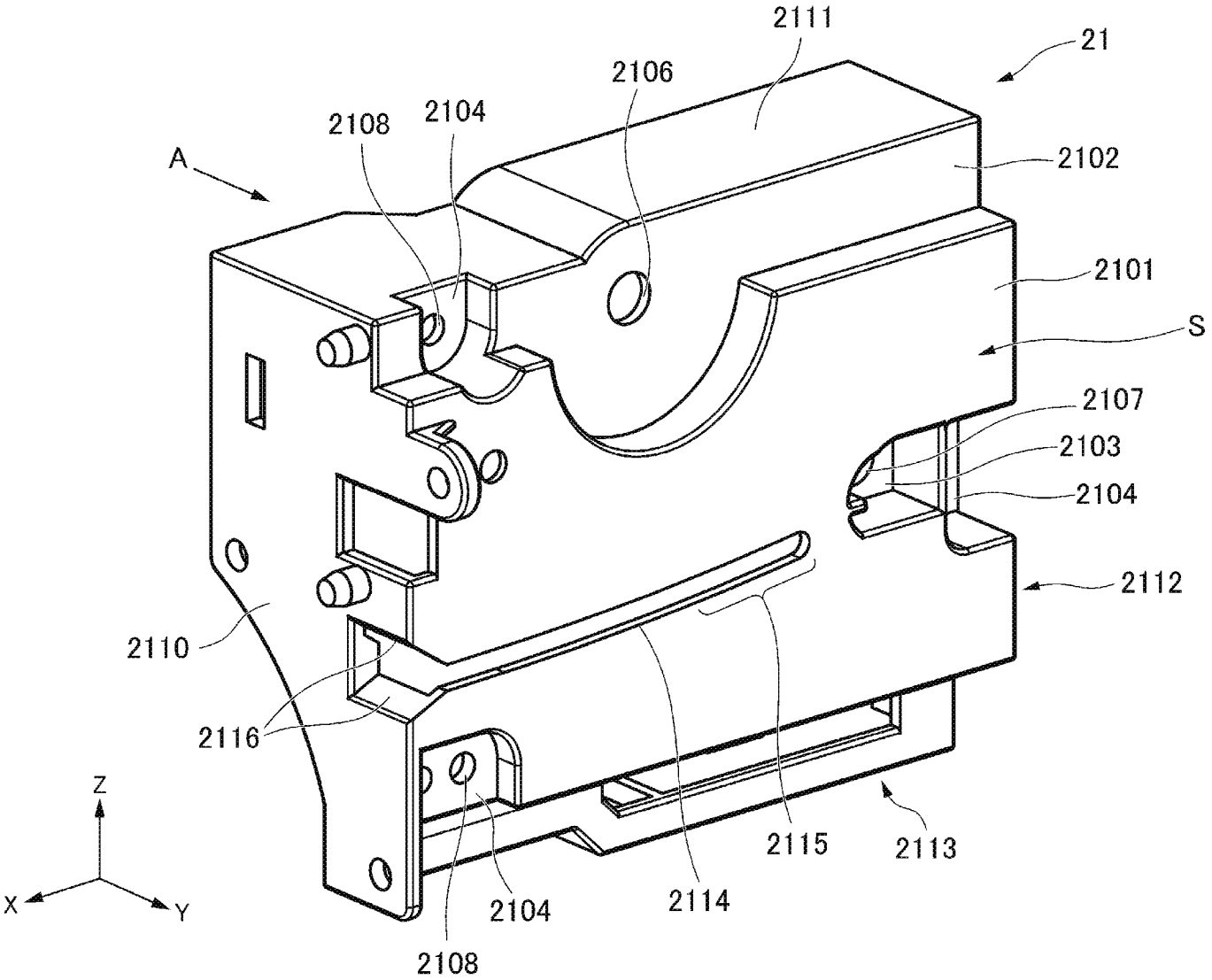
FIG. 4 is a schematic perspective view of a first member in a cassette drawing-in device.
Figure 5:
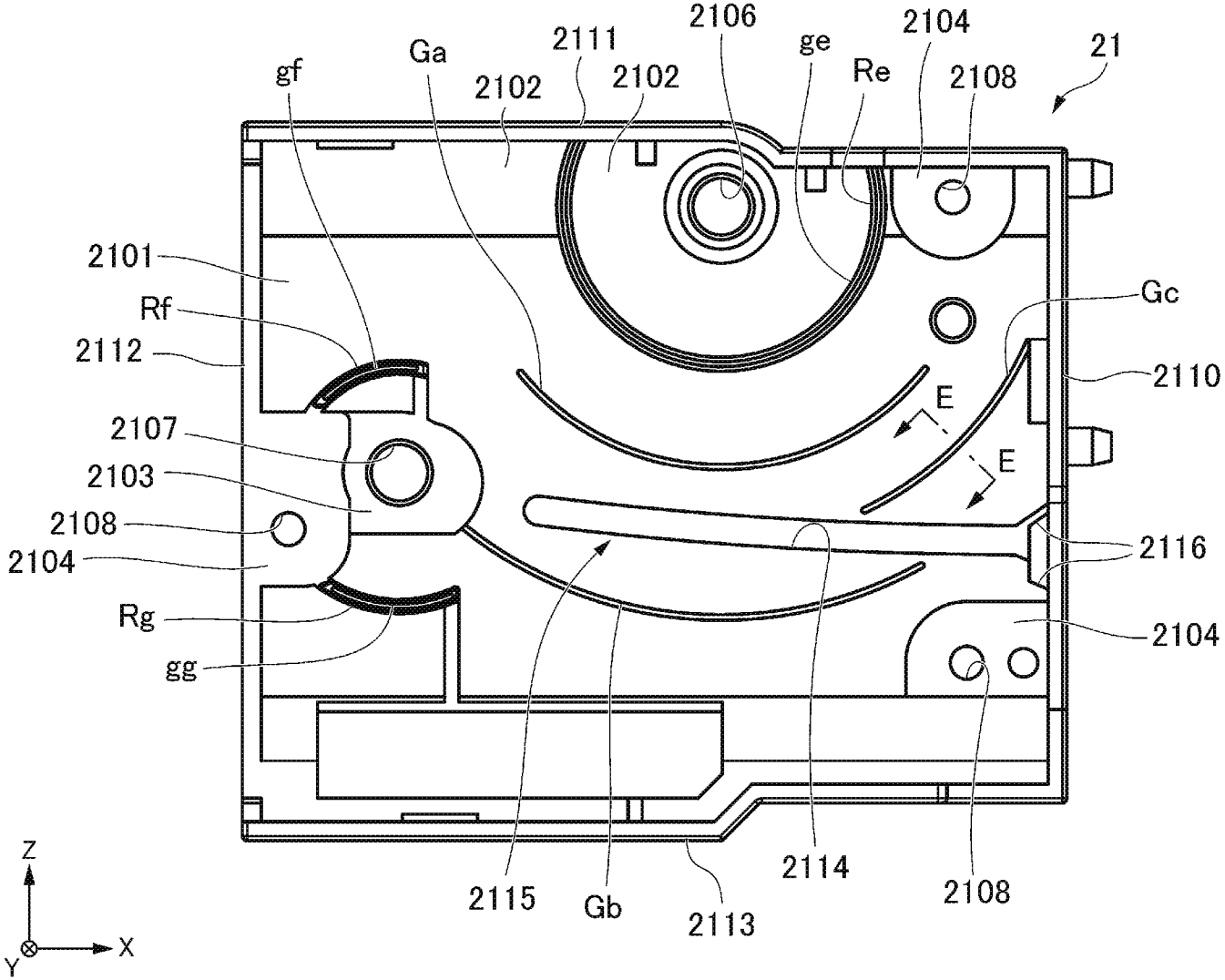
FIG. 5 is a schematic view seen in the direction A of FIG. 4.

FIG. 4 is a schematic perspective view illustrating an example of the first member 21 in a cassette drawing-in device 20 according to the embodiment. FIG. 5 is a schematic view seen in the direction A of FIG. 4.

As illustrated in FIG. 4, the first plate surface portion 2101 is formed with a guide portion 2114 that guides the pin 179 (see FIG. 3) in the Z-axis direction when the paper feed cassette 17 is inserted and drawn out.

The guide portion 2114 is a through hole having a length along the X-axis direction from the end of the first plate surface portion 2101 in the positive direction of the X-axis, and a width slightly wider than an outer diameter of the pin 179 in the Z-axis direction.

The rear end 2115 of the guide portion 2114, which is the end in the negative direction of the X-axis, has a gentler inclination toward the positive direction of the Z-axis as it advances in the negative direction of the X-axis when seen from the negative direction of the Y-axis.

A guide groove 2116 that is open through the front side plate 2110 is formed at the end of the guide portion 2114 in the positive direction of the X-axis.

The groove width of the guide groove 2116 in the Z-axis direction is gradually reduced from a first width wider than the outer diameter of the pin 179 to a second width equal to the guide portion 2114 as it advances from the surface of the front side plate 2110 in the negative direction of the X-axis.

The guide groove 2116 restricts the position in the Z-axis direction of the pin 179 inserted in the introduction hole 102, and guides the pin 179 toward the guide portion 2114 as the pin 179 is moved in the negative direction of the X-axis.

As illustrated in FIG. 5, a shaft support portion 2106 formed of a circular hole penetrates the second plate surface portion 2102 in the thickness direction.

A shaft support portion 2107 formed of a circular hole penetrates the third plate surface portion 2103 in the thickness direction.

A screw insertion hole 2108, through which the screw 45 (see FIG. 3) is inserted, penetrates each screw fastening portion 2104 in the thickness direction.

The second plate surface portion 2102 is provided with an arc-shaped rib Re along a concentric circle with respect to the center of the shaft support portion 2106 when seen from the positive direction of the Y-axis. A lubricant holding portion ge is formed at the central portion of the rib Re in the thickness direction along a longitudinal direction of the rib Re.

Figure 6:
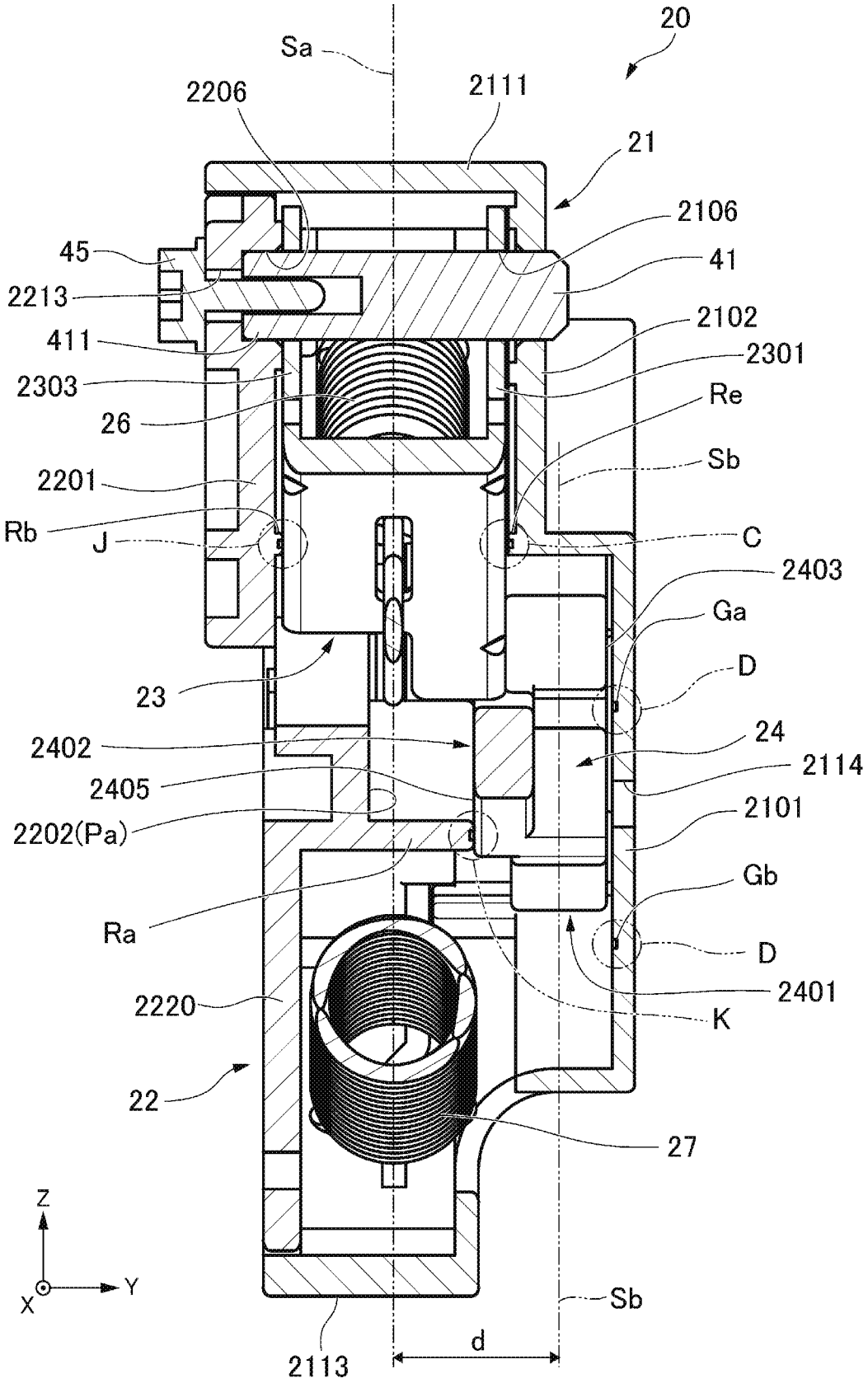
FIG. 6 is a schematic cross-sectional view taken along the line B-B of FIG. 3.
Figure 7:
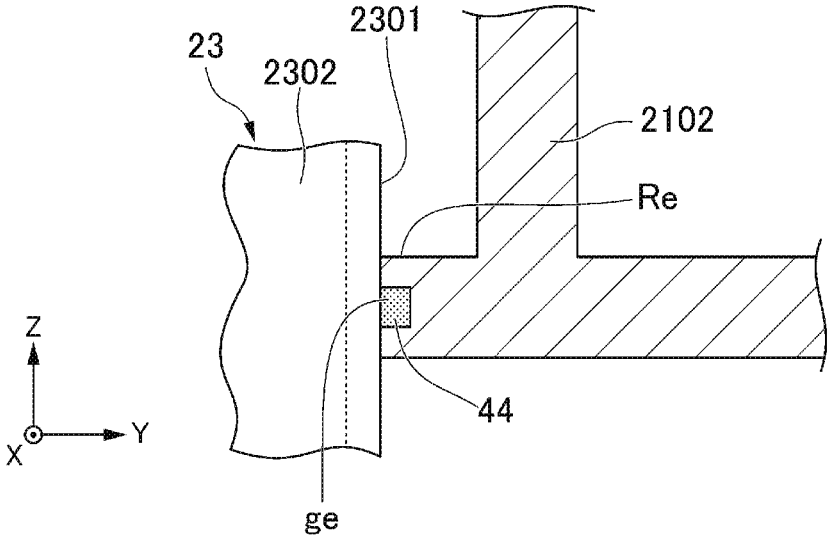
FIG. 7 is an enlarged view illustrating portion C of FIG. 6.

FIG. 6 is a schematic cross-sectional view taken along the line B-B in FIG. 3. FIG. 7 is an enlarged view illustrating the portion C in FIG. 6.

As illustrated in FIG. 6, the rib Re protrudes from the second plate surface portion 2102 in the negative direction of the Y-axis.

As illustrated in FIG. 7, the lubricant holding portion ge is a groove recessed at a tip portion of the rib Re in the positive direction of the Y-axis. The lubricant holding portion ge is filled with a lubricant 44.

The groove shape of the lubricant holding portion ge is not particularly limited as long as it can hold the lubricant 44. In the example illustrated in FIG. 7, the groove shape of the lubricant holding portion ge is rectangular. For example, the groove width of the lubricant holding portion ge may be about 1 mm. For example, the groove depth of the lubricant holding portion ge may be 0.5 mm or more and 1 mm or less.

The type of the lubricant 44 is not particularly limited as long as it can be held in the lubricant holding portion ge. For example, the lubricant 44 may be an oil, grease, solid lubricant, and the like having an appropriate viscosity.

As illustrated in FIG. 6, the surface of the first plate surface portion 2101 in the negative direction of the Y-axis is in the positive direction of the Y-axis with respect to the tip of the rib Re.

As illustrated in FIG. 5, when seen from the positive direction of the Y-axis, arc-shaped lubricant holding portions Ga, Gb, and Gc are formed along concentric circles with respect to the center of the shaft support portion 2106 on the surface of the first plate surface portion 2101 in the negative direction of the Y-axis.

Each of the circles, along which the lubricant holding portions Ga, Gc, and Gb are formed, has a larger radius in order. Each of the circles, along which the lubricant holding portions Ga, Gc, and Gb are formed, has a larger radius than the radius of the circle along which the rib Re is formed.

The lubricant holding portions Ga and Gb are located below the rib Re when seen from the positive direction of the Y-axis. There is the guide portion 2114 between the lubricant holding portions Ga and Gb.

The lubricant holding portion Gc is located above the guide portion 2114 at the end of the first plate surface portion 2101 in the positive direction of the X-axis.

As illustrated in FIG. 6, the lubricant holding portions Ga and Gb are grooves recessed in the positive direction of the Y-axis from the surface of the first plate surface portion 2101 in the negative direction of the Y-axis.

Figure 8:
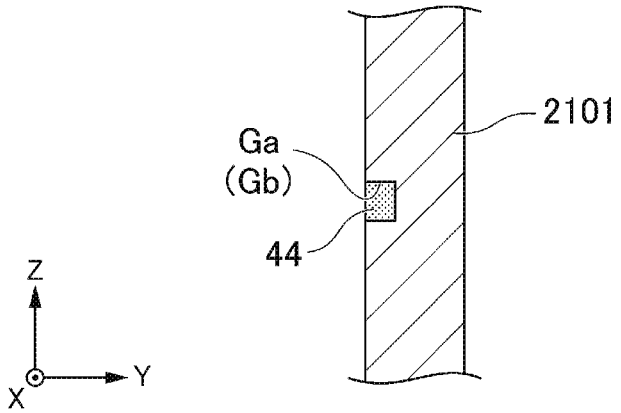
FIG. 8 is an enlarged view illustrating portion D of FIG. 6.

FIG. 8 is an enlarged view illustrating the portion D in FIG. 6.

As illustrated in FIG. 8, each of the lubricant holding portions Ga and Gb is filled with the lubricant 44, like the lubricant holding portion ge. The groove shapes of the lubricant holding portions Ga and Gb are not particularly limited as long as they can hold the lubricant 44. For example, the groove shapes of the lubricant holding portions Ga and Gb are the same as the lubricant holding portion ge that is rectangular.

Figure 9:
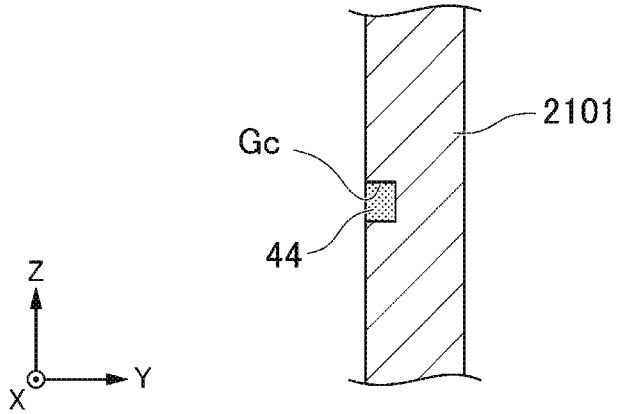
FIG. 9 is a cross-sectional view taken along the line E-E of FIG. 5.

FIG. 9 is a cross-sectional view taken along the line E-E in FIG. 5.

As illustrated in FIG. 9, likewise the lubricant holding portions Ga and Gb, the lubricant holding portion Gc is a groove recessed in the positive direction of the Y-axis from the surface of the first plate surface portion 2101 in the negative direction of the Y-axis. Likewise, the lubricant holding portion ge, the lubricant holding portion Gc is filled with the lubricant 44. The groove shape of the lubricant holding portion Gc is not particularly limited as long as it can hold the lubricant 44. For example, the groove shape of the lubricant holding portion Gc is the same as the lubricant holding portion ge that is rectangular.

As illustrated in FIG. 5, the first plate surface portion 2101 is provided with arc-shaped ribs Rf and Rg formed along a concentric circle with respect to the center of the shaft support portion 2107 when seen from the positive direction of the Y-axis. The rib Rf is located above the shaft support portion 2107. The rib Rg is located below the shaft support portion 2107.

Figure 10:
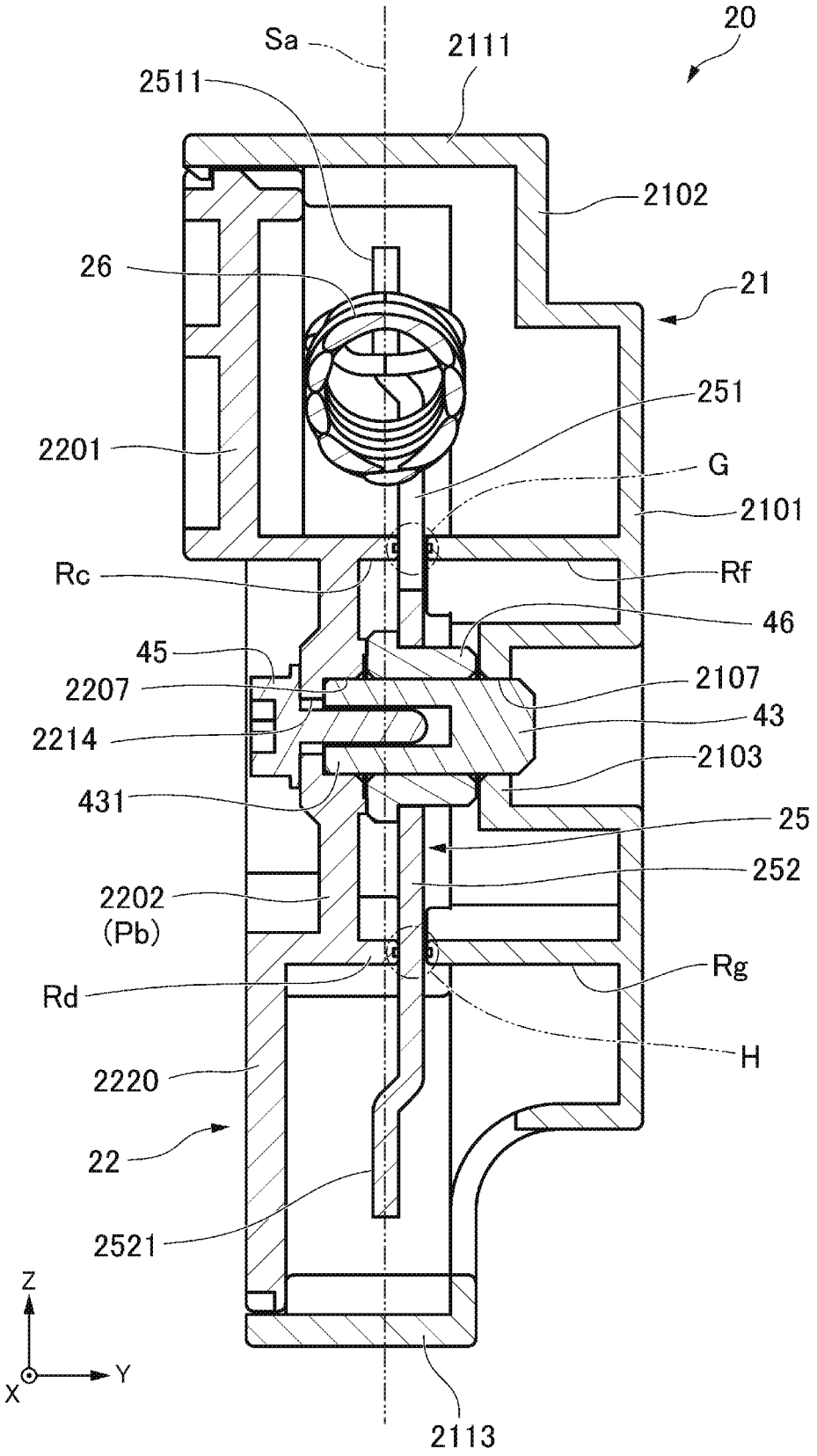
FIG. 10 is a schematic cross-sectional view taken along the line F-F of FIG. 3.

FIG. 10 is a schematic cross-sectional view taken along the line F-F in FIG. 3.

As illustrated in FIG. 10, the ribs Rf and Rg protrude from the first plate surface portion 2101 in the negative direction of the Y-axis. The tip portions of the ribs Rf and Rg protrude in the negative direction of the Y-axis further than the third plate surface portion 2103. The positions of the tip portions of the ribs Rf and Rg in the Y-axis direction are the same as each other.

As illustrated in FIG. 5, a lubricant holding portion gf is formed in the central portion of the rib Rf in the thickness direction along the longitudinal direction of the rib Rf.

A lubricant holding portion gg is formed at the central portion of the rib Rg in the thickness direction along the longitudinal direction of the rib Rg.

Figure 11:
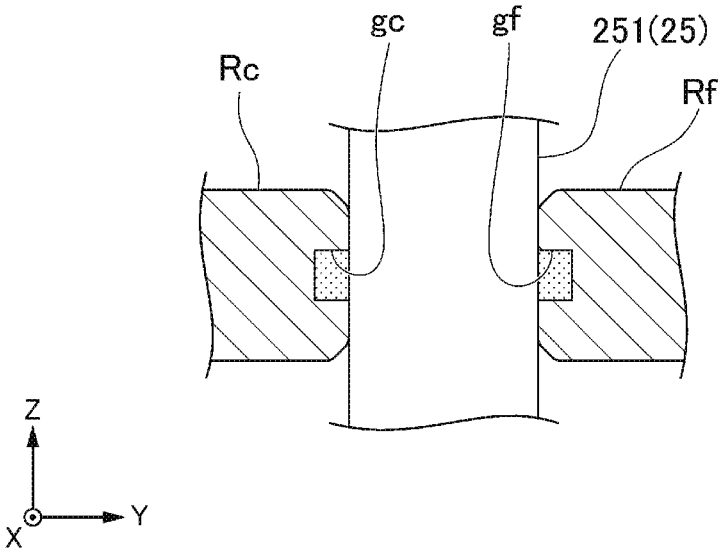
FIG. 11 is an enlarged view illustrating portion G of FIG. 10.
Figure 12:
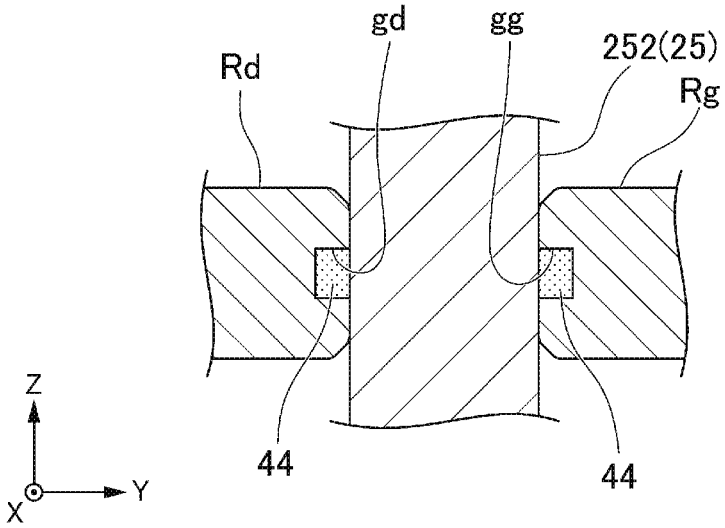
FIG. 12 is an enlarged view illustrating portion H of FIG. 10.

FIG. 11 is an enlarged view illustrating the portion G in FIG. 10. FIG. 12 is an enlarged view illustrating the portion H in FIG. 10.

As illustrated in FIG. 11, the lubricant holding portion gf is a groove recessed at the tip portion of the rib Rf in the negative direction of the Y-axis. Likewise, the lubricant holding portion ge, the lubricant holding portion gf is filled with the lubricant 44.

As illustrated in FIG. 12, the lubricant holding portion gg is a groove recessed at the tip portion of the rib Rg in the negative direction of the Y-axis. Likewise, the lubricant holding portion ge, the lubricant holding portion gg is filled with the lubricant 44.

The groove shapes of the lubricant holding portions gf and gg are not particularly limited as long as they can hold the lubricant 44. For example, the groove shapes of the lubricant holding portions gf and gg are the same as the lubricant holding portion ge that is rectangular.

The shape of the second member 22 will be described together with the internal configuration of the cassette drawing-in device 20.

Figure 13:
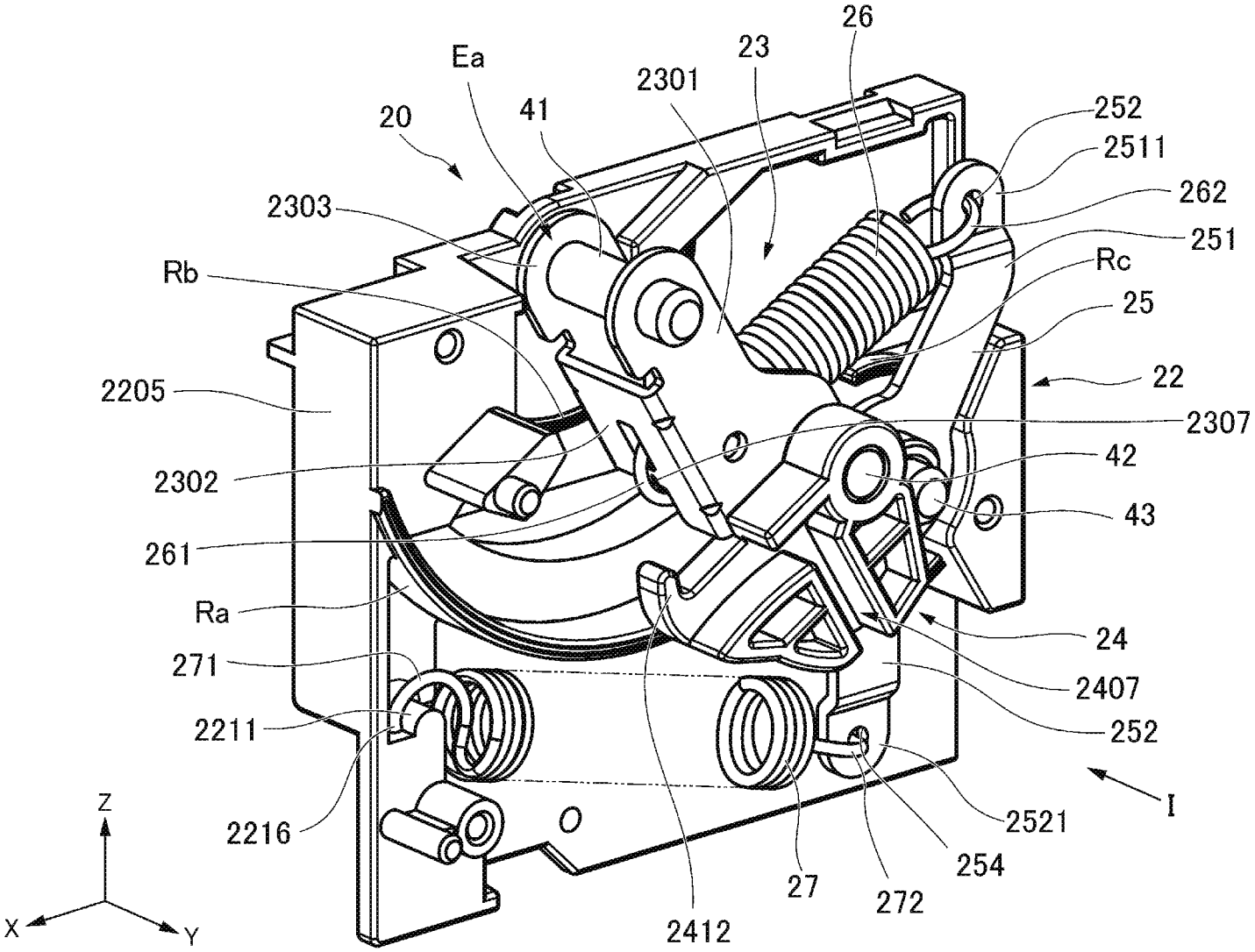
FIG. 13 is a schematic perspective view illustrating an internal configuration of a cassette drawing-in device.
Figure 14:
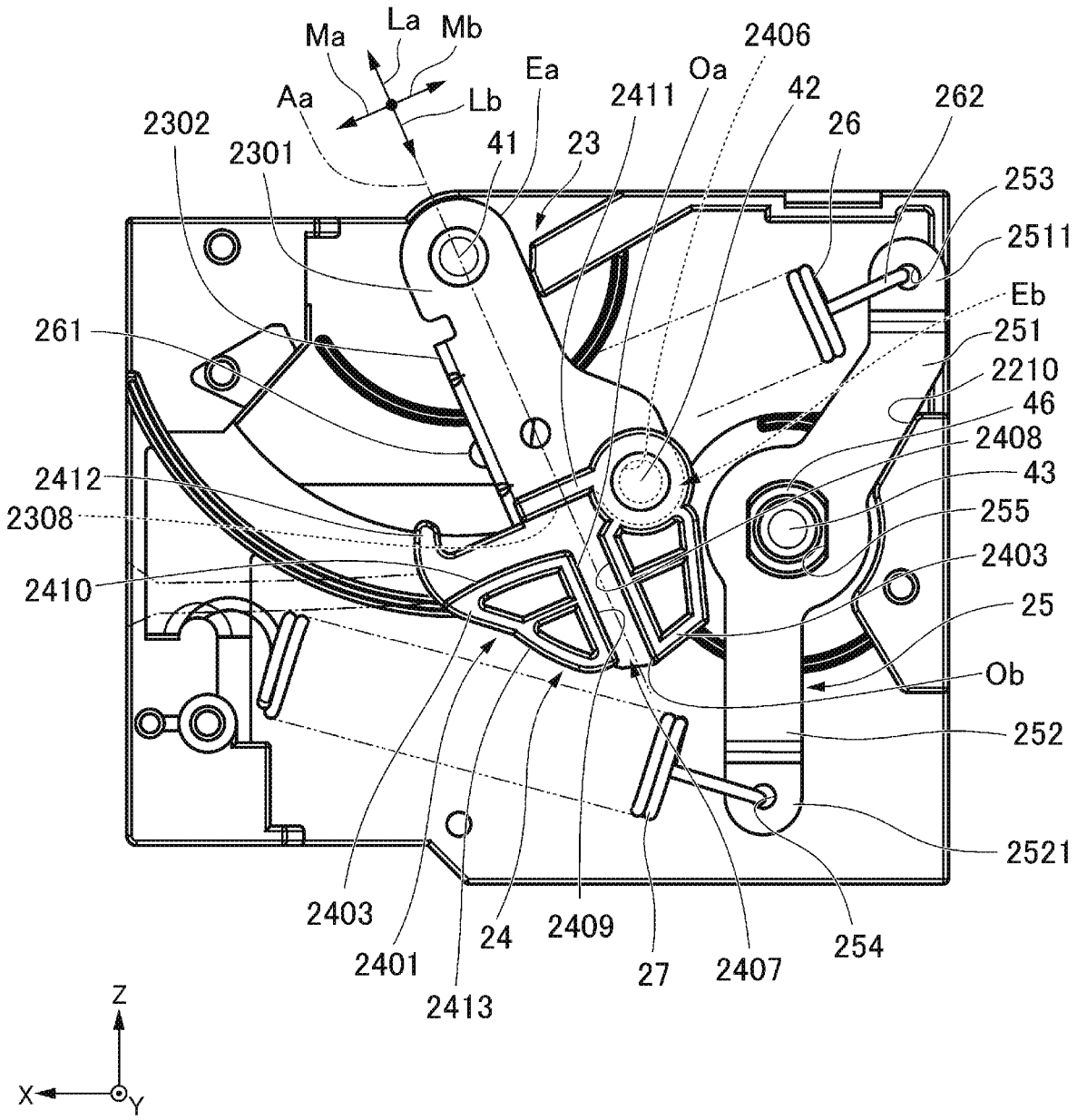
FIG. 14 is a schematic view when seen in the direction I of FIG. 13.

FIG. 13 is a schematic perspective view illustrating the internal configuration of the cassette drawing-in device 20 according to the embodiment. FIG. 14 is a schematic view when seen in the direction I of FIG. 13. FIGS. 13 and 14 illustrate the cassette drawing-in device 20 from which the first member 21 has been removed (omitted).

As illustrated in FIG. 13, the cassette drawing-in device 20 includes a first rotation shaft 41, a first link 23, a second rotation shaft 42, a second link 24, a third rotation shaft 43, a third link 25, a first elastic member 26, and a second elastic member 27 therein. The second rotation shaft 42 is fixed with the first link 23.

Figure 15:
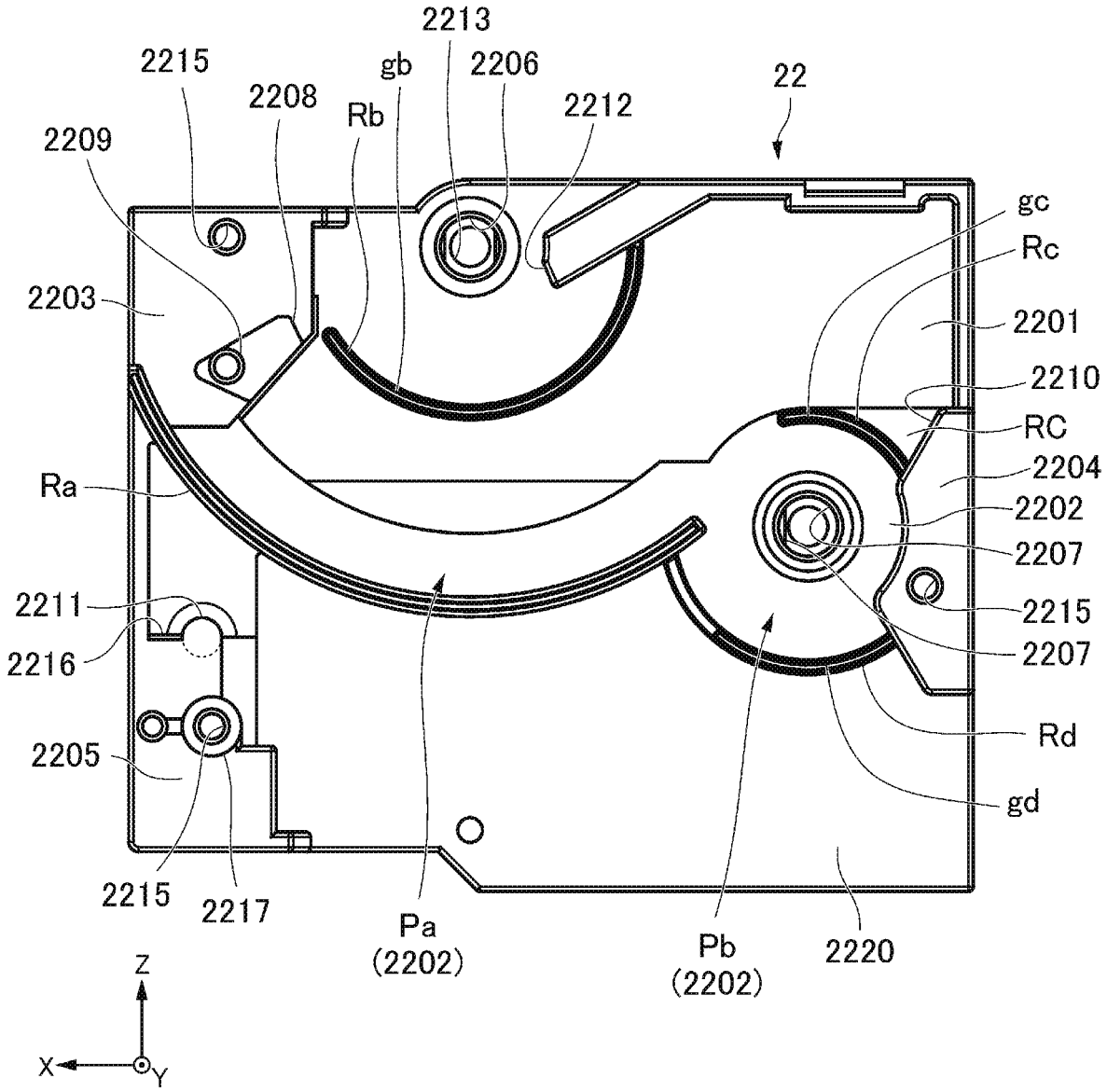
FIG. 15 is a schematic front view illustrating a second member in a cassette drawing-in device.

FIG. 15 is a schematic front view illustrating the second member 22 in the cassette drawing-in device 20 according to the embodiment.

As illustrated in FIG. 15, the outer shape of the second member 22 is substantially rectangular when seen from the negative direction of the Y-axis. As illustrated in FIG. 3, in the state in which the first member 21 is attached, the second member 22 is surrounded from the outside by the front side plate 2110, the upper side plate 2111, the rear side plate 2112, and the lower side plate 2113 of the first member 21.

As illustrated in FIG. 15, the second member 22 includes a first support plate 2201, a second support plate 2220, a first base portion 2202, a second base portion 2203, a third base portion 2204, and a fourth base portion 2205.

The first support plate 2201 and the second support plate 2220 are flat plates parallel to the Z-X plane. The first support plate 2201 forms an upper half of the second member 22. The second support plate 2220 forms a lower half of the second member 22.

As illustrated in FIG. 6, the arrangement position of the second support plate 2220 in the Y-axis direction is slightly deviated in the positive direction of the Y-axis with respect to the first support plate 2201.

The first support plate 2201 and the second support plate 2220 are connected to each other via a step portion at an intermediate portion of the second member 22 in the Z-axis direction.

A shaft support portion 2206 is formed at an end of the first support plate 2201 in the positive direction of the Z-axis. The shaft support portion 2206 is formed at a position facing the shaft support portion 2106 of the first member 21, and is a hole recessed from the first support plate 2201 in the negative direction of the Y-axis. The shaft support portion 2206 holds an end of the first rotation shaft 41 in the negative direction of the Y-axis.

A through hole 2213, through which the screw 45 is inserted, is formed at the central portion of the shaft support portion 2206.

The first rotation shaft 41 has a cylindrical shape as a whole, and includes an engagement portion 411 that is fitted in the shaft support portion 2206 to be stopped from rotating at the end in the negative direction of the Y-axis. The shape of the engagement portion 411 is not particularly limited as long as it can be prevented from rotating with respect to the shaft support portion 2206. For example, the engagement portion 411 may be a plate thinner than the outer diameter of the first rotation shaft 41, a shaft having a D-shaped cross section, or the like.

The first rotation shaft 41 held by the shaft support portion 2206 is fixed with the first support plate 2201 by the screw 45 inserted into the shaft support portion 2206 from the surface of the first support plate 2201 in the negative direction of the Y-axis.

The tip portion of the first rotation shaft 41 fixed with the shaft support portion 2206 is fitted into the shaft support portion 2106 of the first member 21.

As illustrated in FIG. 15, the first support plate 2201 is provided with arc-shaped ribs Rb formed along concentric circles with respect to the center of the shaft support portion 2206 when seen from the positive direction of the Y-axis. A lubricant holding portion gb is formed at the central portion of the rib Rb in the thickness direction along the longitudinal direction of the rib Rb.

As illustrated in FIG. 6, the rib Rb protrudes from the first support plate 2201 in the positive direction of the Y-axis.

Figure 16:
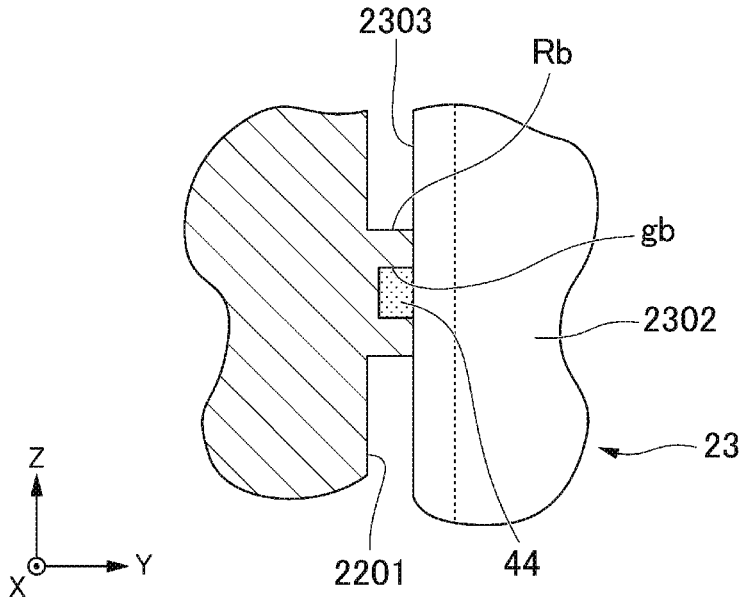
FIG. 16 is an enlarged view illustrating portion J of FIG. 6.

FIG. 16 is an enlarged view illustrating the portion J in FIG. 6.

As illustrated in FIG. 16, the lubricant holding portion gb is a groove recessed at the tip portion of the rib Rb in the negative direction of the Y-axis. Likewise, the lubricant holding portion ge in the first member 21, the lubricant holding portion gb is filled with the lubricant 44.

The groove shape of the lubricant holding portion gb is not particularly limited as long as it can hold the lubricant 44. For example, the groove shape of the lubricant holding portion gb is a rectangle like that of the lubricant holding portion ge in the first member 21.

As illustrated in FIG. 15, the first base portion 2202 straddles the first support plate 2201 and the second support plate 2220 at the intermediate portion of the second member 22 in the Z-axis direction, and protrudes in the positive direction of the Y-axis. The first base portion 2202 forms a plane portion parallel to the Z-X plane. The protruding height of the first base portion 2202 is higher than that of the rib Rb.

The first base portion 2202 includes a first portion Pa and a second portion Pb.

The first portion Pa has an arc shape along a concentric circle with respect to the center of the shaft support portion 2206 when seen from the negative direction of the Y-axis, and is formed outside the rib Rb.

The second portion Pb has a round shape when seen from the negative direction of the Y-axis, and is formed at the end of the first support plate 2201 in the negative direction of the X-axis. The second portion Pb is connected to the end of the first portion Pa in the negative direction of the X-axis.

At the edge of the first portion Pa in the negative direction of the Z-axis, an arc-shaped rib Ra is formed, along a concentric circle with respect to the center of the shaft support portion 2206 when seen from the negative direction of the Y-axis. A lubricant holding portion ga is formed at the central portion of the rib Ra in the thickness direction along the longitudinal direction of the rib Ra.

As illustrated in FIG. 6, the rib Ra protrudes from the first portion Pa in the positive direction of the Y-axis.

Figure 17:
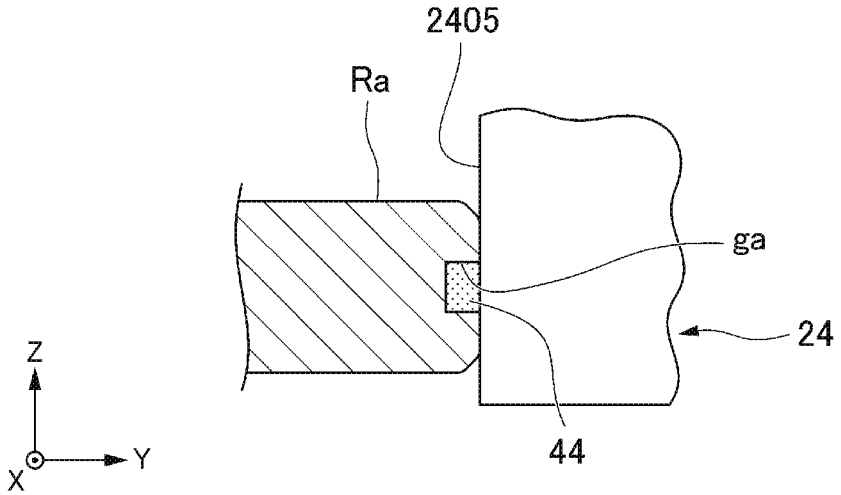
FIG. 17 is an enlarged view illustrating portion K of FIG. 6.

FIG. 17 is an enlarged view illustrating the portion K in FIG. 6.

As illustrated in FIG. 17, the lubricant holding portion ga is a groove recessed at the tip portion of the rib Ra in the negative direction of the Y-axis. Likewise, the lubricant holding portion gb, the lubricant holding portion ga is filled with the lubricant 44.

The groove shape of the lubricant holding portion ga is not particularly limited as long as it can hold the lubricant 44. For example, the groove shape of the lubricant holding portion ga is the same as the lubricant holding portion gb that is rectangular.

As illustrated in FIG. 15, a shaft support portion 2207 is formed at the central portion of the second portion Pb.

As illustrated in FIG. 10, the shaft support portion 2207 is formed at a position facing the shaft support portion 2107 of the first member 21, and is a hole recessed from the second portion Pb in the negative direction of the Y-axis. The shaft support portion 2207 holds an end of the third rotation shaft 43 in the negative direction of the Y-axis.

A through hole 2214, through which the screw 45 is inserted, is formed in the central portion of the shaft support portion 2207.

The third rotation shaft 43 has a cylindrical shape as a whole, and includes an engagement portion 431 that is fitted in the shaft support portion 2206 to be stopped from rotating at the end in the negative direction of the Y-axis. The shape of the engagement portion 431 is not particularly limited as long as it can be prevented from rotating with respect to the shaft support portion 2207. For example, the engagement portion 431 may have the same shape as the engagement portion 411 in the first rotation shaft 41.

The third rotation shaft 43 held by the shaft support portion 2207 is fixed with the second portion Pb by the screw 45 inserted into the shaft support portion 2207 from the surface of the second portion Pb in the negative direction of the Y-axis.

The tip portion of the third rotation shaft 43 fixed with the shaft support portion 2207 is fitted into the shaft support portion 2107 of the first member 21.

As illustrated in FIG. 15, an arc-shaped rib Rc along a concentric circle with respect to the center of the shaft support portion 2207 when seen from the negative direction of the Y-axis is formed at the edge of the second portion Pb in the positive direction of the Z-axis. A lubricant holding portion gc is formed at the central portion of the rib Rc in the thickness direction along the longitudinal direction of the rib Rc. The protruding height of the rib Rc from the first base portion 2202 is lower than that of the rib Ra.

As illustrated in FIG. 10, the rib Rc protrudes from the second portion Pb in the positive direction of the Y-axis.

As illustrated in FIG. 11, the lubricant holding portion gc is a groove recessed at the tip portion of the rib Rc in the negative direction of the Y-axis. Likewise, the lubricant holding portion gb, the lubricant holding portion gc is filled with the lubricant 44.

The groove shape of the lubricant holding portion gc is not particularly limited as long as it can hold the lubricant 44. For example, the groove shape of the lubricant holding portion gc is the same as the lubricant holding portion gb that is rectangular.

As illustrated in FIG. 15, an arc-shaped rib Rd along a concentric circle with respect to the center of the shaft support portion 2207 when seen from the negative direction of the Y-axis is formed at the edge of the second portion Pb in the negative direction of the Z-axis. A lubricant holding portion gd is formed at the central portion of the rib Rd in the thickness direction along the longitudinal direction of the rib Rd.

As illustrated in FIG. 10, the rib Rd protrudes from the second portion Pb in the positive direction of the Y-axis. The protruding height of the rib Rd from the first base portion 2202 is equal to the protruding height of the rib Rc.

As illustrated in FIG. 12, the lubricant holding portion gd is a groove recessed at the tip portion of the rib Rd in the negative direction of the Y-axis. Likewise, the lubricant holding portion gb, the lubricant holding portion gd is filled with the lubricant 44.

The groove shape of the lubricant holding portion gd is not particularly limited as long as it can hold the lubricant 44. For example, the groove shape of the lubricant holding portion gd is the same as the lubricant holding portion gb that is rectangular.

As illustrated in FIG. 15, the second base portion 2203 protrudes in the positive direction of the Y-axis between the ends of the ribs Rb and Ra in the positive direction of the X-axis. The height of the second base portion 2203 in the positive direction of the Y-axis is higher than that of the first base portion 2202 and lower than that of the rib Ra.

A first stopper 2208 protrudes from the second base portion 2203 in the positive direction of the Y-axis.

The first stopper 2208 restricts the rotational position of the first link 23 in the counterclockwise direction and the position in the positive direction of the X-axis.

An engagement pin 2209 engaged with the second link 24 protrudes from the tip of the first stopper 2208 in the protruding direction.

The shape of the engagement pin 2209 is not particularly limited as long as it can be engaged with the second link 24. For example, the engagement pin 2209 is an elliptical column having a long diameter in the X-axis direction.

In the first support plate 2201, a second stopper 2212 protrudes in the positive direction of the Y-axis between the shaft support portion 2206 and the end of the rib Rb in the negative direction of the X-axis.

The second stopper 2212 restricts the rotational position of the first link 23 in the clockwise direction and the position in the negative direction of the X-axis.

At the end of the second support plate 2220 in the negative direction of the X-axis, the third base portion 2204 protrudes in the positive direction of the Y-axis on the side of the second portion Pb in the negative direction of the X-axis. The height of the third base portion 2204 with respect to the first support plate 2201 in the positive direction of the Y-axis is equal to the height of the second base portion 2203. The height of the third base portion 2204 is higher than the tips of the ribs Rc and Rd and lower than the tip of the rib Ra.

A third stopper 2210 formed of an inclined surface that restricts the rotation of the third link 25 is formed on the side surface of the third base portion 2204 on the positive direction of the Z-axis side in the positive direction of the X-axis.

At the end of the second support plate 2220 in the positive direction of the X-axis, the fourth base portion 2205 protrudes below the rib Ra in the positive direction of the Y-axis.

The height of the fourth base portion 2205 with respect to the first support plate 2201 in the positive direction of the Y-axis is equal to the height of the second base portion 2203. A cylindrical second locking portion 2211 having a length in the Y-axis direction is formed between the upper end of the fourth base portion 2205 and the first support plate 2201. A through hole 2216 penetrating in the Z-axis direction is formed in the positive direction of the X-axis of the second locking portion 2211.

As illustrated in FIG. 13, a first hook 271 of the second elastic member 27 is locked in the second locking portion 2211.

As illustrated in FIG. 15, when seen from the negative direction of the Y-axis, a boss 2217 protrudes in the positive direction of the Y-axis on the fourth base portion 2205 below the second locking portion 2211.

The second base portion 2203, the third base portion 2204, and the boss 2217 of the fourth base portion 2205 come into contact with the screw fastening portions 2104 of the first member 21 at the three positions respectively, when the first member 21 is attached. The second base portion 2203, the third base portion 2204, and the boss 2217 of the fourth base portion 2205 are formed with screw holes 2215 to which the screws 45 are fastened at positions coaxial with the screw insertion holes 2108 formed in the screw fastening portions 2104, respectively.

As illustrated in FIG. 13, the first link 23 is rotationally supported by the first rotation shaft 41 fixed to the second member 22. The first link 23 includes a first side wall portion 2301, a second side wall portion 2303, the second rotation shaft 42, and a connecting plate 2302.

Figure 18:
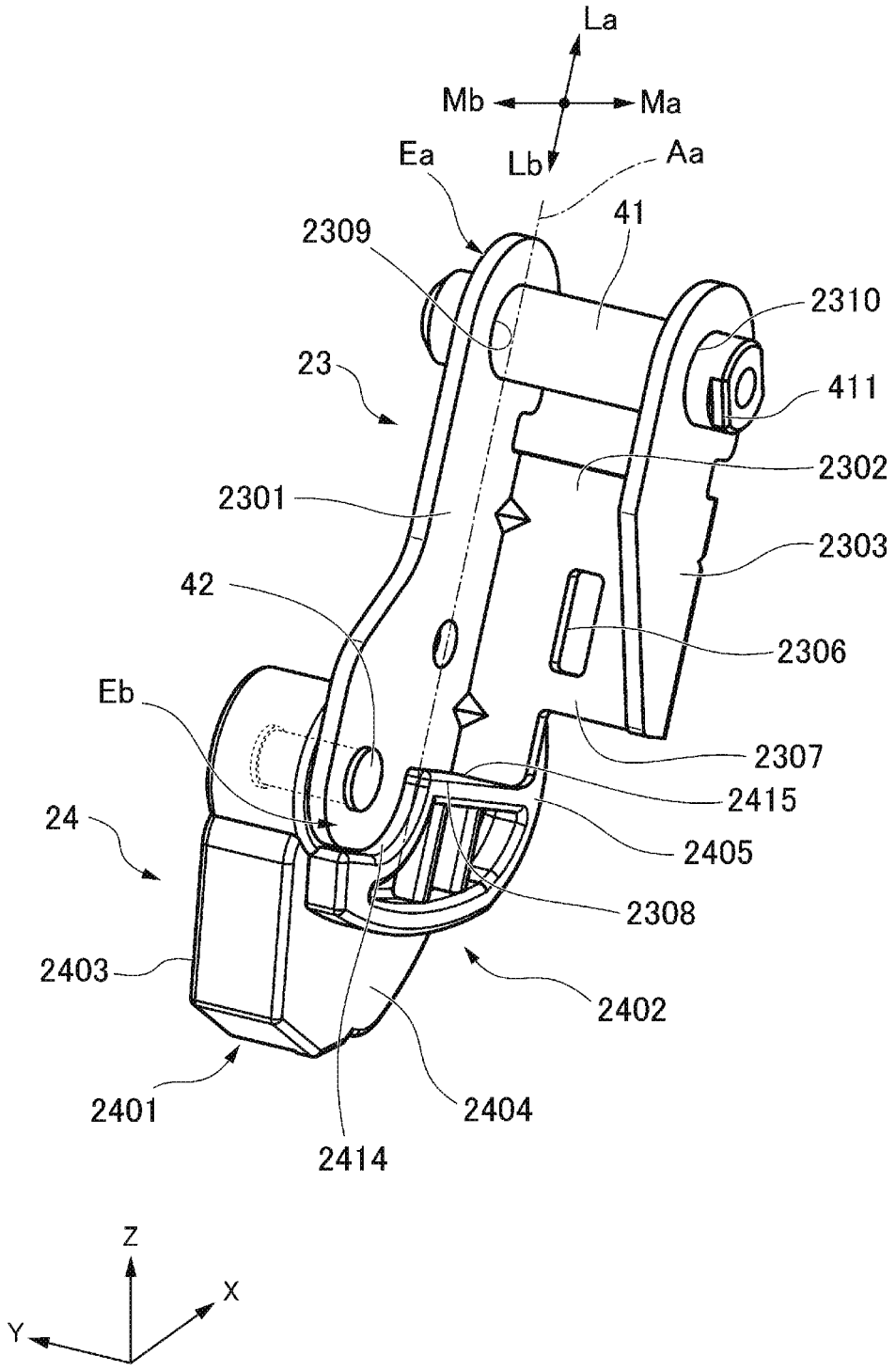
FIG. 18 is a schematic perspective view illustrating an example of a first link and a second link in a cassette drawing-in device.

FIG. 18 is a schematic perspective view illustrating an example of the first link 23 and the second link 24 in the cassette drawing-in device 20 of the embodiment.

As illustrated in FIG. 18, the first side wall portion 2301 and the second side wall portion 2303 are flat plates elongated in one direction parallel to the Z-X plane. The first side wall portion 2301 is longer than the second side wall portion 2303.

At the first end Ea of the first link 23, the first side wall portion 2301 and the second side wall portion 2303 face each other in the Y-axis direction. The first side wall portion 2301 and the second side wall portion 2303 at the first end Ea are provided with bearing portions 2309 and 2310 that are rotatably fitted to the first rotation shaft 41, respectively.

The bearing portions 2309 and 2310 may be formed of sliding bearings sliding on the first rotation shaft 41, but in the example shown in FIG. 18, they are circular holes penetrating the first side wall portion 2301 and the second side wall portion 2303 in the thickness direction. The bearing portions 2309 and 2310 are fitted with the first rotation shaft 41 coaxially with the central axis of the first rotation shaft 41.

The first link 23 is rotatably supported by the first rotation shaft 41 at the bearing portions 2309 and 2310 of the first end Ea.

The connecting plate 2302 connects the first side wall portion 2301 and the second side wall portion 2303 to each other so that the distance in the Y-axis direction is constant.

As illustrated in FIG. 14, the connecting plate 2302 forms an outer surface on the left side of the first link 23 in the drawing when seen from the negative direction of the Y-axis. The connecting plate 2302 is a flat plate parallel to an axis Aa passing through the center of the first rotation shaft 41 and the center of the first end Ea in the Z-X plane.

Hereinafter, in the direction along the axis Aa on the Z-X plane, the direction away from the first end Ea downward is defined as an Lb direction, and the opposite direction is defined as an La direction. In the direction orthogonal to the axis Aa on the Z-X plane, the direction from the axis Aa toward the connecting plate 2302 is defined as an Ma direction, and the opposite direction is defined as a Mb direction. The La direction and the Lb direction are radial directions in the rotational movement of the first link 23. The Ma direction and the Mb direction are tangential directions of the rotating circle in the rotational movement of the first link 23.

A lower end locking portion 2308 and a second end Eb are formed at the end of the first link 23 in the Mb direction.

The lower end locking portion 2308 is formed by the edge of the first side wall portion 2301 and the connecting plate 2302 on the same plane orthogonal to the axis Aa.

The second end Eb is adjacent to the lower end locking portion 2308 on the first side wall portion 2301 in the Mb direction. The outer shape of the second end Eb is a U shape protruding in the Lb direction with respect to the lower end locking portion 2308. The second end Eb is in the Mb direction with respect to the axis Aa.

As illustrated in FIG. 18, the cylindrical second rotation shaft 42 protruding in the positive direction of the Y-axis is fixed in the second end Eb.

As illustrated in FIG. 14, when seen from the negative direction of the Y-axis, the second rotation shaft 42 is arranged at a position deviated in the Mb direction with respect to the axis Aa in the Z-X plane.

As illustrated in FIG. 18, a through hole 2306 is formed in the central portion of the connecting plate 2302 in the Y-axis direction, and a first locking portion 2307 for locking the first elastic member 26 (see FIG. 13) is formed at a lower end of the through hole 2306.

The second link 24 is arranged on the side of the second end Eb of the first side wall portion 2301 in the positive direction of the Y-axis, and is rotationally supported by the second rotation shaft 42.

The second link 24 illustrated in FIG. 14 is locked with the lower end locking portion 2308 of the first link 23. The lower end locking portion 2308 restricts the second link 24 from rotating in the clockwise direction.

Hereinbelow, unless otherwise specified in the description of the first link 23 and the second link 24, as illustrated in FIG. 14, the shape and arrangement of the second link 24 will be described based on a state (hereinafter, the anti-rotation state) in which the second link 24 is locked with the lower end locking portion 2308 of the first link 23 and is prevented from rotating in the clockwise direction.

If the pin 179 is engaged with the engagement groove 2407, since the second link 24 has a narrow rotatable range of the second rotation shaft 42, the amount of rotation from the anti-rotation state is small.

As illustrated in FIG. 18, the second link 24 includes a main body portion 2401 and a protrusion 2402.

The main body portion 2401 is arranged in the positive direction of the Y-axis with respect to the first side wall portion 2301. The main body portion 2401 has a plate shape located between the first side surface 2403 and the second side surface 2404, and has a thickness in the Y-axis direction. Likewise, the first side wall portion 2301, the first side surface 2403 and the second side surface 2404 are planes parallel to the Z-X plane.

The first side surface 2403 is located in the positive direction of the Y-axis with respect to the tip of the second rotation shaft 42 in the positive direction of the Y-axis. The second side surface 2404 is in sliding contact with the first side wall portion 2301.

As illustrated in FIG. 14, when seen from the negative direction of the Y-axis, the main body portion 2401 includes a shaft hole 2406 penetrating in the thickness direction of the main body portion 2401, which is rotatably fitted with the second rotation shaft 42.

The main body portion 2401 extends from the vicinity of the shaft hole 2406 in the Ma direction and the Lb direction.

In the main body portion 2401, an engagement groove 2407 that is longer in the Lb direction in the anti-rotation state is formed closer to the Lb direction with respect to the shaft hole 2406.

The engagement groove 2407 is recessed in the negative direction of the Y-axis from the first side surface 2403. The groove width and groove depth of the engagement groove 2407 are large enough to allow the pin 179 to be inserted.

The inner surface of the engagement groove 2407 in the Mb direction is a first side wall 2408. The inner surface of the engagement groove 2407 in the Ma direction is a second side wall 2409.

The first side wall 2408 and the second side wall 2409 are planes orthogonal to the Z-X plane. The first side wall 2408 and the second side wall 2409 are parallel to the axis Aa in the anti-rotation state.

The distance between the first side wall 2408 and the second side wall 2409 (groove width of the engagement groove 2407) is slightly larger than the outer diameter of the pin 179.

A lower opening Ob that is open at the outer peripheral portion of the main body portion 2401 is formed at the end of the engagement groove 2407 in the Lb direction.

An upper opening Oa that is open inside the main body portion 2401 is formed at the end of the second side wall 2409 in the La direction.

An upper guide surface 2410 is connected to the upper opening Oa in the Ma direction. The upper guide surface 2410 is a curved surface that has a length in the Ma direction as a whole and slightly bulges in the La direction.

An upper end wall 2411 is provided at an end of the main body portion 2401 in the La direction at a position facing the upper opening Oa. A space is formed between the upper end wall 2411 and the upper guide surface 2410 such that the pin 179 can be moved along the upper guide surface 2410.

At the end of the main body portion 2401 in the La direction and at the extreme side in the Ma direction, a hook 2412 protrudes, curving toward the axis Aa as it goes in the La direction.

An inclined surface 2413, inclining in the Mb direction as it advances in the Lb direction, is formed between the end of the upper guide surface 2410 in the Ma direction and the end of the second side wall 2409 in the Lb direction.

As illustrated in FIG. 18, the protrusion 2402 protrudes from the main body portion 2401 in the negative direction of the Y-axis with respect to the first side wall portion 2301. A third side surface 2405 parallel to the first side surface 2403 is formed at the tip of the protrusion 2402 in the protruding direction.

A curved surface 2414 curved along an outer circumference of the second end Eb, and a locking portion 2415 locked with the lower end locking portion 2308 of the first link 23 are provided on the outer surface of the protrusion 2402 in the La direction.

In the anti-rotation state in which the locking portion 2415 is locked with the lower end locking portion 2308, the central axis of the groove width of the engagement groove 2407 is along the axis Aa.

As illustrated in FIG. 14, the third link 25 is a plate having a thickness in the Y-axis direction. The third link 25 has a V-shaped outer shape in which a first arm 251 and a second arm 252 are connected at an obtuse angle when seen from the negative direction of the Y-axis.

A mounting hole 255 for mounting the bearing 46 penetrates in the thickness direction at the center of the connection portion between the first arm 251 and the second arm 252.

The bearing 46 is non-rotatably mounted in the mounting hole 255.

The type of the bearing 46 is not particularly limited. For example, a sliding bearing may be used as the bearing 46.

The third link 25 is mounted on the third rotation shaft 43 with the bearing 46 mounted in the mounting hole 255. The third link 25 is rotatably supported by the third rotation shaft 43 in the bearing 46.

The first arm 251 protrudes upward from the central portion of the third link 25. When the first arm 251 is rotated about the third rotation shaft 43 in the clockwise direction, the first arm 251 is locked with the third stopper 2210 such that the rotation in the clockwise direction is restricted.

In a state in which the first arm 251 is locked with the third stopper 2210, the second arm 252 has a length in the negative direction of the Z-axis from the central portion of the third link 25.

A locking hole 253 penetrates the first end 2511, which is the tip portion of the first arm 251, in the thickness direction. The first elastic member 26 is locked in the locking hole 253.

A locking hole 254 penetrates the second end 2521, which is the tip portion of the second arm 252, in the thickness direction. The second elastic member 27 is locked in the locking hole 254.

As illustrated in FIG. 10, the first end 2511 and the second end 2521 are located on a plane Sa deviated in the negative direction of the Y-axis with respect to the first arm 251 and the second arm 252. The plane Sa is a plane that is passed through the center of the through hole 2306 of the first link 23 and is parallel to the Z-X plane.

As illustrated in FIG. 13, the first elastic member 26 urges the first locking portion 2307 of the first link 23 and the first end 2511 of the third link 25 in a direction of approaching each other.

For example, the first elastic member 26 is a tension coil spring that has at its ends in the longitudinal direction a first hook 261 and a second hook 262.

The first hook 261 is locked with the first locking portion 2307. The second hook 262 is locked with the locking hole 253. The position where the first elastic member 26 is locked with the first link 23 and the third link 25 is substantially on the plane Sa, and the urging force of the first elastic member 26 is applied on the first locking portion 2307 of the first link 23 and the first end 2511 of the third link 25 in the plane Sa.

Due to the urging force from the first elastic member 26, the first link 23 receives a moment of a counterclockwise force about the first rotation shaft 41 when seen from the negative direction of the Y-axis. Likewise, the third link 25 receives a moment of a counterclockwise force about the third rotation shaft 43 when seen from the negative direction of the Y-axis.

The second elastic member 27 urges the second end 2521 of the third link 25 in the direction toward the second locking portion 2211.

For example, the second elastic member 27 is a tension coil spring that has at its ends in the longitudinal direction a first hook 271 and a second hook 272.

The first hook 271 is locked with the second locking portion 2211. The second hook 272 is locked with the locking hole 254. The position where the second elastic member 27 is locked with the third link 25 is substantially on the plane Sa, and the urging force of the second elastic member 27 is applied on the second end 2521 of the third link 25 substantially in the plane Sa.

Due to the urging force from the second elastic member 27, the third link 25 receives a moment of a clockwise force about the third rotation shaft 43 when seen from the negative direction of the Y-axis.

The arrangement of the first link 23, the second link 24, and the third link 25 inside the cassette drawing-in device 20 will be described.

As illustrated in FIG. 3, when the first member 21 is fixed with the second member 22 by the three screws 45, the positional relationship between the first member 21 and the second member 22 is fixed. For example, the positional relationship between the first member 21 and the second member 22 in the Y-axis direction is fixed, and an internal space having a width determined in the Y-axis direction is formed according to the uneven shape of the first member 21 and the second member 22 inside the cassette drawing-in device 20.

As illustrated in FIG. 6, the first link 23 is accommodated between the second plate surface portion 2102 of the first member 21 and the first support plate 2201 of the second member 22.

The first side wall portion 2301 of the first link 23 slidably comes into contact with the rib Re of the first member 21.

The second side wall portion 2303 of the first link 23 slidably comes into contact with the rib Rb of the second member 22.

Since the rib Re is arranged along a concentric circle centered on the first rotation shaft 41 fixed with the shaft support portion 2106, a sliding portion of the first side wall portion 2301 on the rib Re is an arc centered on the first rotation shaft 41.

When the first link 23 is rotated about the first rotation shaft 41, the contact state between the first link 23 and the rib Re illustrated in FIG. 7 is maintained in the circumferential direction of rotation. The sliding portion on the rib Re is lubricated with the lubricant 44 filled in the lubricant holding portion ge. Since the lubricant 44 coming out of the lubricant holding portion ge remains in the vicinity of the lubricant holding portion ge even when the first link 23 is rotated, the lubricating performance is maintained for a long period of time.

Likewise, since the rib Rb is arranged along a concentric circle centered on the first rotation shaft 41 inserted in the shaft support portion 2206, a sliding portion of the second side wall portion 2303 on the rib Rb is an arc centered on the first rotation shaft 41.

When the first link 23 is rotated about the first rotation shaft 41, the contact state between the first link 23 and the rib Rb illustrated in FIG. 16 is maintained in the circumferential direction of rotation. The sliding portion on the rib Rb is lubricated with the lubricant 44 filled in the lubricant holding portion gb in the same manner as the sliding portion on the rib Re.

As illustrated in FIG. 10, the third link 25 is accommodated between the first plate surface portion 2101 of the first member 21 and the second portion Pb of the first base portion 2202 of the second member 22.

The first arm 251 of the third link 25 is located between the rib Rf of the first member 21 and the rib Rc of the first member 21, and slidably comes into contact with each of them.

The second arm 252 of the third link 25 is located between the rib Rg of the first member 21 and the rib Rd of the second member 22, and slidably comes into contact with each of them.

Since the ribs Rf and Rc are arranged along the concentric circles centered on the third rotation shaft 43 fixed with the shaft support portion 2207, the sliding portion on the ribs Rf and Rc in the first arm 251 and the sliding portion on the ribs Rg and Rd in the second arm 252 are arcs centered on the third rotation shaft 43.

When the third link 25 is rotated about the third rotation shaft 43, the contact state between the third link 25 and the ribs Rf, Rc, Rg, and Rd illustrated in FIGS. 11 and 12 is maintained in the circumferential direction of rotation. Each sliding portion on the ribs Rf, Rc, Rg, and Rd is lubricated with the lubricant 44 filled in the lubricant holding portions gf, gc, gg, and gd, respectively, in the same manner as the sliding portion on the rib Re.

As illustrated in FIG. 6, the second link 24 is accommodated between the first plate surface portion 2101 of the first member 21 and the first portion Pa of the first base portion 2202 of the second member 22.

The third side surface 2405 of the protrusion 2402 of the second link 24 slidably comes into contact with the rib Ra of the second member 22. The first side surface 2403 of the main body portion 2401 of the second link 24 is arranged at a position where it overlaps with at least one of the lubricant holding portions Ga, Gb, and Gc formed on the first plate surface portion 2101 of the first member 21 when seen from the Y-axis direction. The first side surface 2403 is in contact with the inner surface of the first plate surface portion 2101.

Since the rib Ra is arranged along the concentric circle centered on the first rotation shaft 41 fixed with the shaft support portion 2106, the sliding portion of the third side surface 2405 on the rib Ra is an arc centered on the first rotation shaft 41.

When the first link 23 is rotated about the first rotation shaft 41, the second link 24 is rotated around the first rotation shaft 41 while substantially interlocking with the first link 23. When the second link 24 is rotated, the contact state between the second link 24 and the rib Ra illustrated in FIG. 17 is maintained in the circumferential direction of rotation. The sliding portion on the rib Ra is lubricated with the lubricant 44 filled in the lubricant holding portion ga in the same manner as the sliding portion on the rib Re.

The first side surface 2403 of the main body portion 2401 of the second link 24 slidably comes into contact with the first plate surface portion 2101 of the first member 21. The first side surface 2403 is arranged at a position where it overlaps with at least one of the lubricant holding portions Ga, Gb, and Gc formed on the first plate surface portion 2101 of the first member 21 when seen from the Y-axis direction.

Since the lubricant holding portions Ga, Gb, and Gc are arranged along the concentric circles centered on the first rotation shaft 41 fixed with the shaft support portion 2106, the first side surface 2403 slides on the first plate surface portion 2101 with the longitudinal direction of the lubricant holding portions Ga, Gb, and Gc coinciding with the circumferential direction of rotation.

The first side surface 2403 in the vicinity of the lubricant holding portions Ga, Gb, and Gc is lubricated by the lubricant 44 filled in the lubricant holding portions Ga, Gb, and Gc. The moving direction of the lubricant 44 is the circumferential direction of the rotation. Since the lubricant 44 coming out of the lubricant holding portions Ga, Gb, and Gc remains in the vicinity of the lubricant holding portions Ga, Gb, and Gc even when the first side surface 2403 is rotated, the lubricating performance is maintained for a long period of time.

The operation of the cassette drawing-in device 20 will be described.

As illustrated in FIG. 2, the paper feed cassette 17 can be inserted into and removed from the image processing apparatus 100 in the first direction Da. In this embodiment, the first direction Da is the X-axis direction. The second direction Db, which is the protruding direction of the pin 179, is the Y-axis direction. The third direction Dc, which is orthogonal to the first direction Da and the second direction Db, is the Z-axis direction.

When the paper feed cassette 17 is inserted into the image processing apparatus 100 in the first direction Da, the pin 179 approaches the cassette drawing-in device 20.

Figure 19:
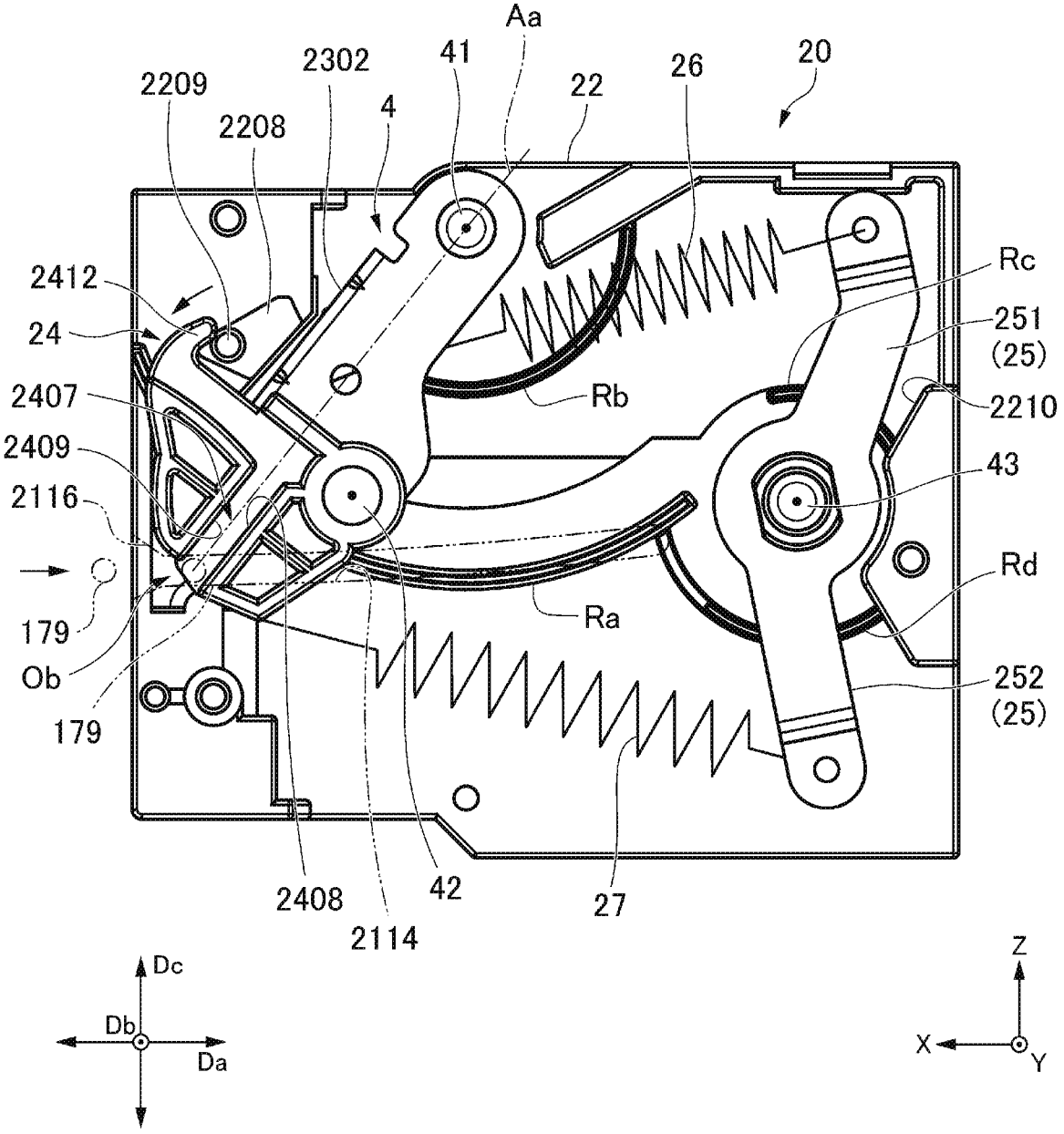
FIG. 19 is a schematic view illustrating an operation of a cassette drawing-in device according to an embodiment.
Figure 20:
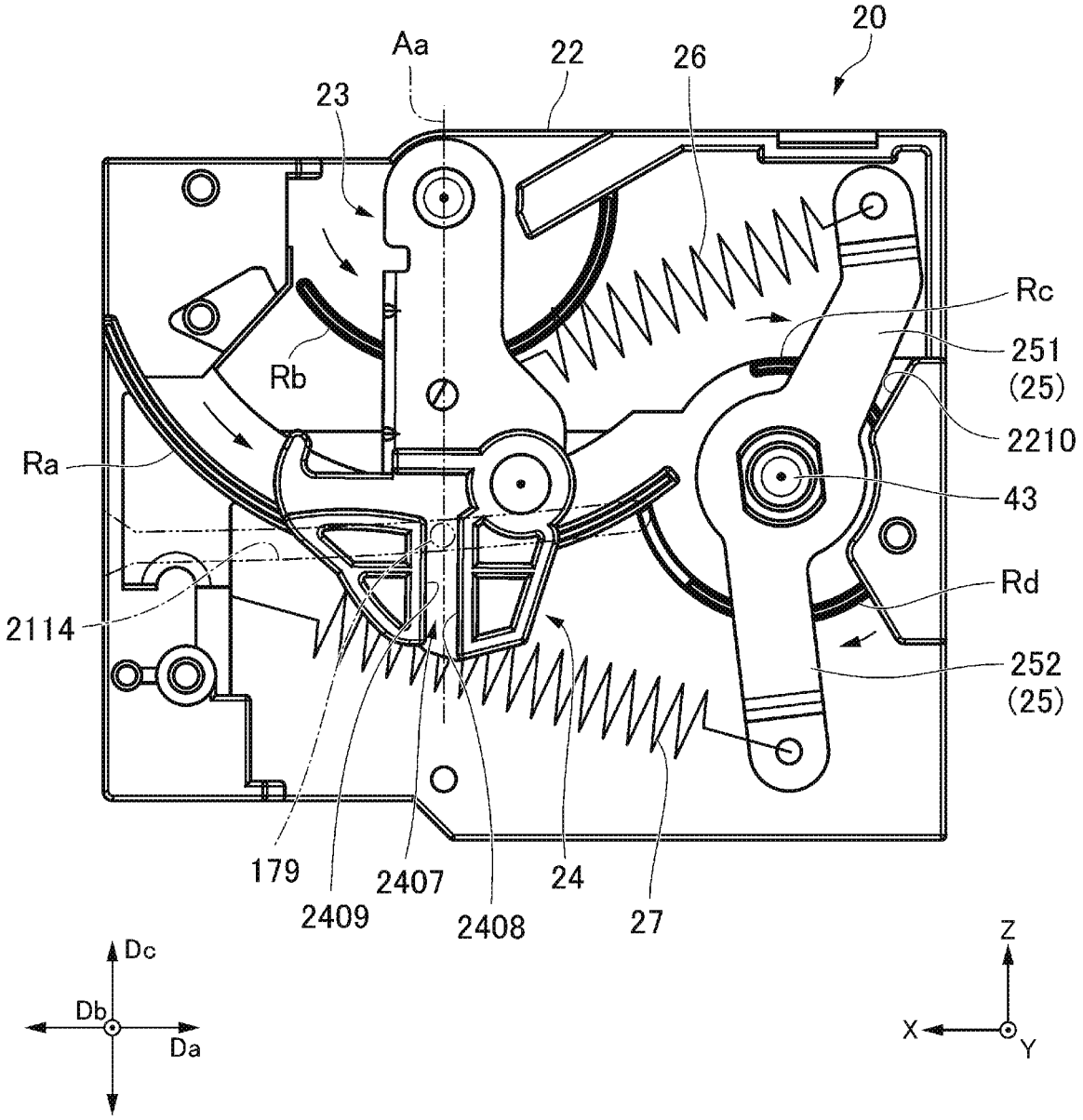
FIG. 20 is a schematic view illustrating an operation of a cassette drawing-in device.
Figure 21:
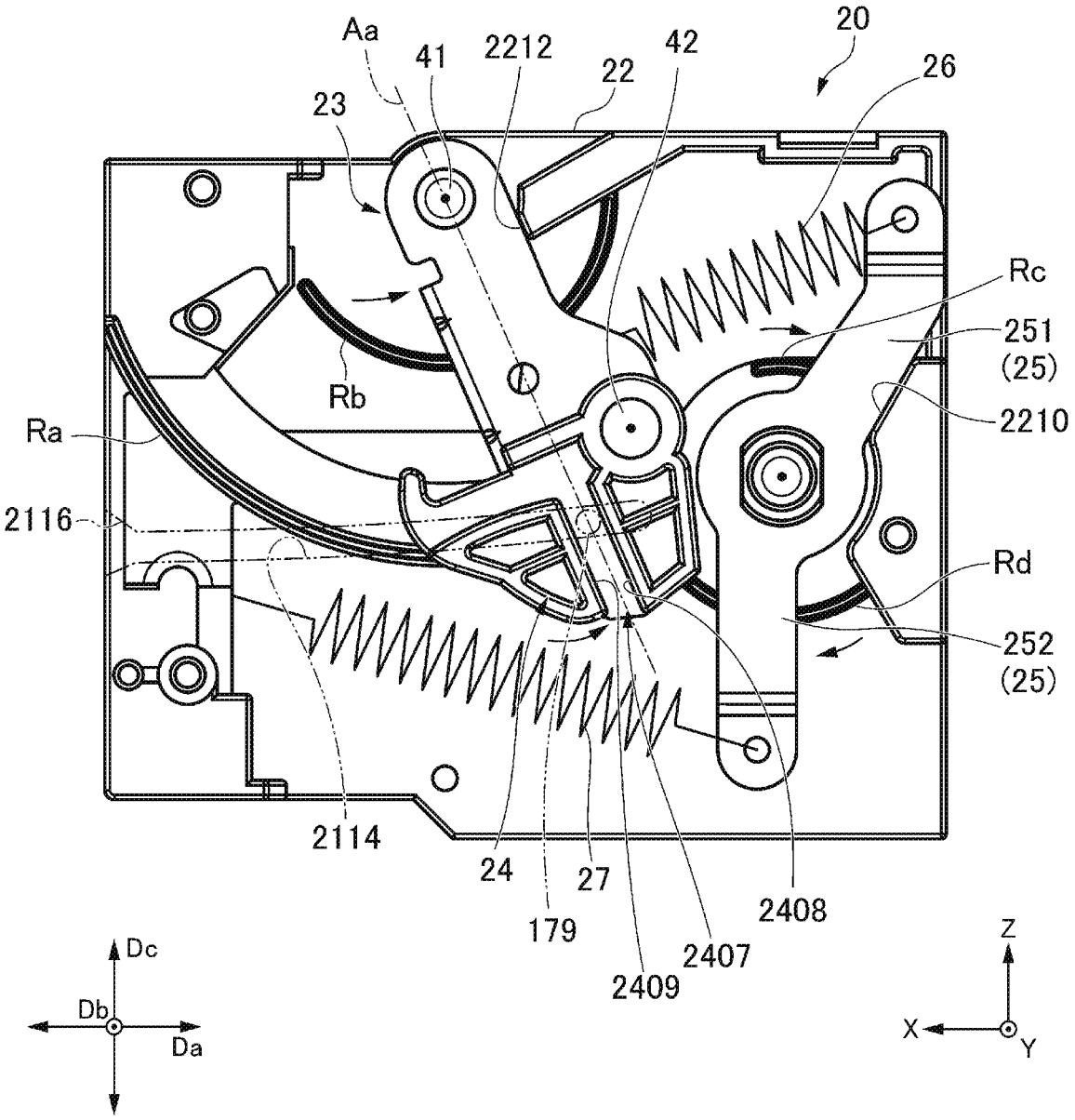
FIG. 21 is a schematic view illustrating an operation of a cassette drawing-in device.

FIGS. 19 to 21 are schematic views illustrating the operation of the cassette drawing-in device 20 according to the embodiment.

In FIGS. 19 to 21, the illustration of the first member 21 is omitted except for the guide portion 2114 and the guide groove 2116 indicated by the alternate long and short dash line such that the internal operation of the cassette drawing-in device 20 can be more easily understood. The first elastic member 26 and the second elastic member 27 are only schematically illustrated.

The inside of the cassette drawing-in device 20 before the insertion of the paper feed cassette 17 is illustrated in FIG. 19.

The first link 23 and the second link 24 are each in a home position. At the home positions, the positions and postures of the first link 23 and the second link 24 are held.

The first link 23 can be rotated in the depicted clockwise direction until the connecting plate 2302 of the first link 23 is close to the first stopper 2208.

The second link 24 is in the anti-rotation state. The hook 2412 of the second link 24 is locked with the engagement pin 2209. When the hook 2412 of the second link 24 in the anti-rotation state is locked with the engagement pin 2209, the first link 23 and the second link 24 are not able to be rotated around the first rotation shaft 41.

In the home position, the axis Aa at the first link 23 is inclined toward the positive direction of the Z-axis as it goes toward the negative direction of the X-axis. The axis Aa is inclined at an acute angle with respect to the X-axis in a plane parallel to the Z-X plane.

In the home positions of the first link 23 and the second link 24, the lower opening Ob overlaps with the end of the guide portion 2114 in the positive direction of the X-axis when seen from the negative direction of the Y-axis.

In the home position, the first elastic member 26 and the second elastic member 27 extend more than they are in their natural state. The third link 25 is stopped at a position where the moments of forces applied from the first elastic member 26 and the second elastic member 27 are balanced. The first arm 251 is separated from the third stopper 2210.

The pin 179 (see the pin 179 on the left side in FIG. 19) approaching the cassette drawing-in device 20 is moved inside the guide groove 2116. Since the pin 179 fixed with the cassette side link 178 can be rotated about the rotation shaft 1781 (see FIG. 3) of the cassette side link 178 in the Z-X plane, the pin 179 can be moved in the third direction Dc.

When the paper feed cassette 17 is further inserted, the pin 179 comes into contact with the guide groove 2116 and is moved along the guide groove 2116 toward the guide portion 2114.

The tip portion of the pin 179 inserted into the inside of the first member 21 through the guide portion 2114 is inserted into the engagement groove 2407 through the lower opening Ob at the second link 24.

Then, the pin 179 is moved in the negative direction of the X-axis, while the position of the third direction Dc is restricted by the guide portion 2114. The pin 179 comes into contact with the first side wall 2408 and urges the second link 24 in the direction along the guide portion 2114.

The second link 24 urged through the first side wall 2408 is rotated about the second rotation shaft 42 in the counterclockwise direction, and the hook 2412 and the engagement pin 2209 are disengaged.

When the engagement pin 2209 and the hook 2412 are disengaged, since the first link 23 is rotatable around the first rotation shaft 41, the stretched first elastic member 26 and the second elastic member 27 are contracted. The third link 25 is rotated about the third rotation shaft 43 in the clockwise direction, and the first link 23 is rotated about the first rotation shaft 41 in the counterclockwise direction.

When the first link 23 starts to rotate, the second link 24 together with the first link 23 is also rotated about the first rotation shaft 41 in the counterclockwise direction.

When the second link 24 is rotated together with the first link 23, the second side wall 2409 comes into contact with the pin 179, and a force in the insertion direction of the paper feed cassette 17 is applied from the second side wall 2409 to the pin 179.

The paper feed cassette 17 is drawn in in the insertion direction without being pushed by the user, by the force applied on the pin 179 from the second side wall 2409.

FIG. 20 illustrates a state in which the paper feed cassette 17 is further inserted in the negative direction of the X-axis and the pin 179 is moved along the guide portion 2114.

In FIG. 20, as the pin 179 is moved along the guide portion 2114 in the negative direction of the X-axis, the counterclockwise rotation of the first link 23 proceeds, and the axis Aa of the first link 23 is substantially parallel to the Z-axis. At this rotational position, the engagement groove 2407 is also substantially parallel to the Z-axis.

Due to the force relationship of the elastic restoring force of the first elastic member 26 and the second elastic member 27, the third link 25 continues to rotate in the clockwise direction, and the first arm 251 is separated from the third stopper 2210.

FIG. 21 illustrates the position of the pin 179 in a state in which the paper feed cassette 17 is further inserted in the negative direction of the X-axis and the paper feed cassette 17 is completely inserted.

As illustrated in FIG. 21, the pin 179 is moved in the negative direction of the X-axis and the positive direction of the Z-axis along the curved shape of the rear end 2115 of the guide portion 2114. The first link 23 receives the moment of the force from the first elastic member 26 in the counterclockwise direction, and the rotation is stopped by being locked with the second stopper 2212.

The third link 25 receives the moment of the force from the second elastic member 27 in the clockwise direction, and the rotation is stopped when the first arm 251 is locked with the third stopper 2210.

The pin 179 is located between the first side wall 2408 and the second side wall 2409 of the engagement groove 2407.

The position of the paper feed cassette 17 in the first direction Da is fixed within the range of a gap between the pin 179 and the engagement groove 2407, and the paper feed cassette 17 is completely inserted.

As described above, from the time when the hook 2412 and the engagement pin 2209 are disengaged, to the time when the insertion illustrated in FIG. 21 is completed, due to the contraction of the first elastic member 26 and the second elastic member 27, the pin 179 continues to receive the drawing-in force applied from the second side wall 2409 in the insertion direction.

After the user pushes the paper feed cassette 17 in the insertion direction in order to disengage the hook 2412 and the engagement pin 2209, the paper feed cassette 17 is smoothly drawn in.

Immediately before the completion of the insertion illustrated in FIG. 21, the damper 18 illustrated in FIG. 2 comes into contact with the inner plate 101. The damper 18 absorbs the impact force generated on the paper feed cassette 17 and the cassette drawing-in device 20 when the paper feed cassette 17 is stopped.

When the completely inserted paper feed cassette 17 is drawn out in the first direction Da, the operations described above are performed in the reverse order. Since the drawing-in force in the insertion direction is applied on the paper feed cassette 17 from the second side wall 2409 via the pin 179, the user draws out the paper feed cassette 17 against the drawing-in force in the drawing-out direction opposite to the insertion direction.

When the pin 179 is moved along the guide portion 2114 to the end of the guide portion 2114 in the positive direction of the X-axis, the hook 2412 is locked with the first stopper 2208, and the first link 23 and the second link 24 return to the home position. The application of the drawing-in force on the pin 179 is ceased.

The pin 179 is drawn out from the lower opening Ob of the engagement groove 2407 to the guide groove 2116, and the pin 179 and the engagement groove 2407 are disengaged.

The user can draw out the paper feed cassette 17 to the front side of the apparatus main body 15.

For example, when the hook 2412 and the engagement pin 2209 in the home position are disengaged for some reason before the paper feed cassette 17 is inserted, the first link 23 and the second link 24 are moved to the positions illustrated in FIG. 21 without engaging the pin 179 with the engagement groove 2407.

In the embodiment, the pin 179 can be engaged with the engagement groove 2407 from the state described above. When the user inserts the paper feed cassette 17 from the state described above, the pin 179 introduced into the guide portion 2114 rides on the upper guide surface 2410. Furthermore, when the user pushes the paper feed cassette 17 in the negative direction of the X-axis, the second link 24 is rotated about the second rotation shaft 42 in the counterclockwise direction illustrated in the drawing by the force applied on the upper guide surface 2410 from the pin 179 moving along the guide portion 2114. When the user inserts the paper feed cassette 17 to the position immediately before the paper feed cassette 17 is completely inserted, the pin 179 enters the engagement groove 2407 from the upper guide surface 2410 through the upper opening Oa and is engaged with the engagement groove 2407 as illustrated in FIG. 21.

The cassette drawing-in device 20 is in the same state as when the insertion is completed.

Then, as described above, when the user draws out the paper feed cassette 17, the first link 23 and the second link 24 return to the home position.

As described above, the first link 23, the second link 24, and the third link 25 are rotated respectively when the paper feed cassette 17 is inserted and drawn out.

When the first link 23, the second link 24, and the third link 25 are not rotated smoothly, the drawing-in of the paper feed cassette 17 may be hindered or the load on the user may occur.

The actions of the ribs and the lubricant holding portion provided on the first member 21 and the second member 22 in the embodiment will be described.

As illustrated in FIG. 6, when the first link 23 is rotated, since the first link 23 is sandwiched between the ribs Rb and Re, the first link 23 is stably rotated in the plane Sa without shaking in the Y-axis direction. Furthermore, since the sliding portion between the first link 23 and the ribs Rb and Re is lubricated by the lubricant 44, the sliding resistance accompanying the rotation of the first link 23 is reduced.

When the second link 24 is rotated, since the second link 24 is sandwiched between the rib Ra and the first plate surface portion 2101 provided with the lubricant holding portion Ga, the second link 24 is stably rotated without shaking in the Y-axis direction. Furthermore, since the sliding portion between the second link 24 and the rib Ra and the first plate surface portion 2101 is lubricated by the lubricant 44, the sliding resistance accompanying the rotation of the second link 24 is reduced.

As illustrated in FIG. 10, when the third link 25 is rotated, since the first arm 251 is sandwiched between the ribs Rc and Rf, and the second arm 252 is gripped by the ribs Rd and Rg, the third link 25 is stably rotated without shaking in the Y-axis direction. Furthermore, since the sliding portion between the third link 25 and the ribs Rb, Rf, Rd, and Rg is lubricated by the lubricant 44, the sliding resistance accompanying the rotation is reduced.

The first link 23 is locked with the first elastic member 26 and the third link 25 is locked with the first elastic member 26 and the second elastic member 27, and subject to external forces from each of them.

These external forces are applied substantially on a plane Sa. Since the first link 23 and the third link 25 do not receive the moment of the force around the axis intersecting the normal of the plane Sa from the first elastic member 26 and the second elastic member 27, the sliding load is reduced by the sliding contact with the rib, and the first link 23 and the third link 25 can be rotated smoothly.

Figure 22:
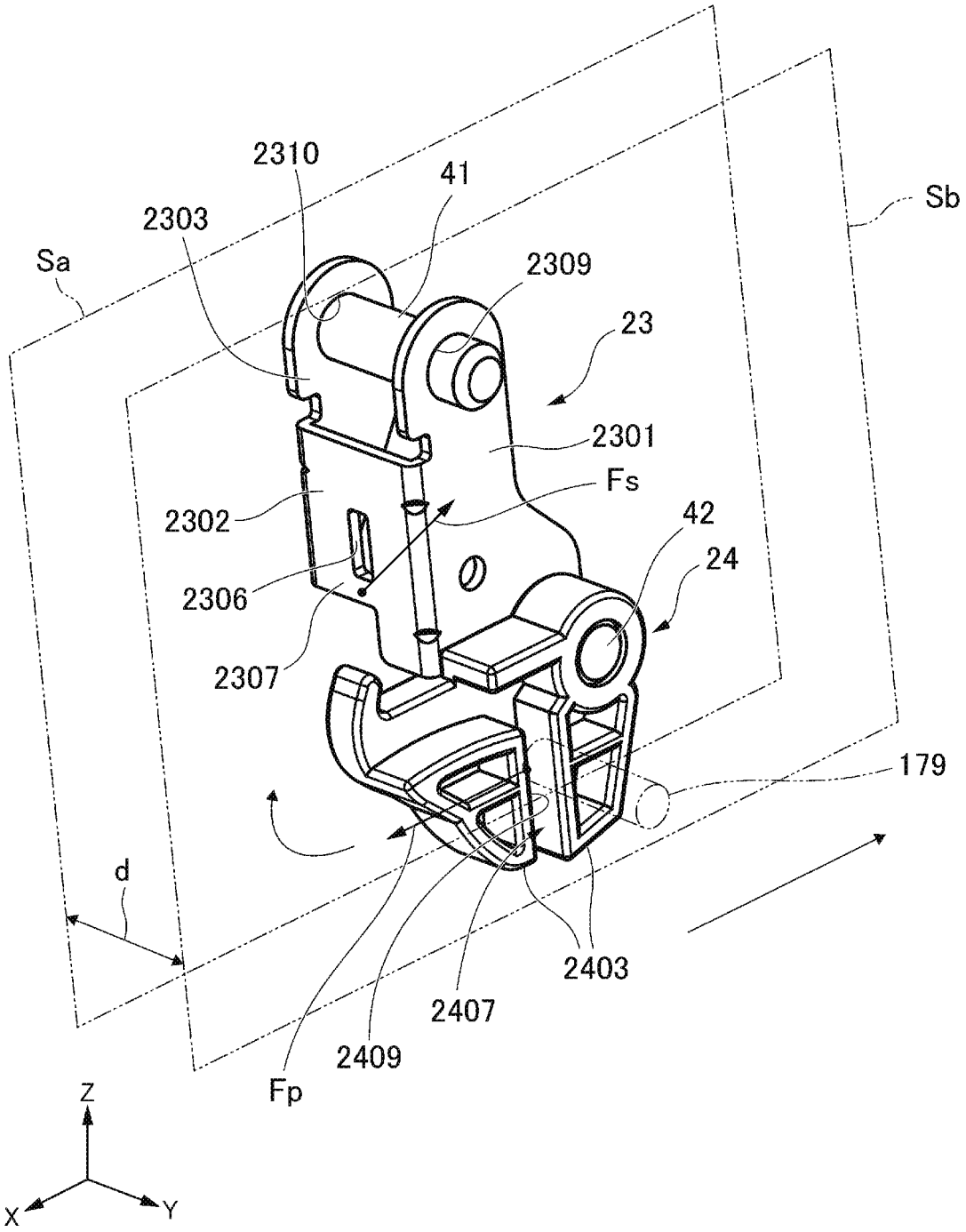
FIG. 22 is a schematic perspective view illustrating an operation of a cassette drawing-in device.

FIG. 22 is a schematic perspective view illustrating an operation of the cassette drawing-in device 20.

For example, when the second link 24 draws in the pin 179 in the insertion direction, the first link 23 receives the urging force Fs from the first elastic member 26 at the first locking portion 2307.

The second link 24 receives an external force Fp from the pin 179 that comes into contact with the second side wall 2409.

The position where the pin 179 and the engagement groove 2407 are engaged to each other (the point of application of the external force Fp) is on the plane Sb separated from the plane Sa by d in the positive direction of the Y-axis.

When the second link 24 is not in a sliding contact with the rib Ra and the first plate surface portion 2101, since the second link 24 is rotated in the X-Y plane by the moment of the external force Fp, the moment of the external force Fp is applied on the first link 23 through the second link 24.

Since the first link 23 is rotated in the X-Y plane, the contact state with the ribs Re and Rb is uneven, and the sliding load increases.

In this embodiment, the second link 24 slides while sandwiched between the rib Ra and the first plate surface portion 2101. Even when the moment of the external force Fp is applied, since the rotation of the second link 24 itself in the XY plane is suppressed and the posture of the first link 23 is kept parallel to the plane Sa, the sliding load of the first link 23 and the second link 24 is suppressed.

As described above, according to an example embodiment, it is possible to provide the cassette drawing-in device 20 capable of reducing the load on the user and smoothly inserting the paper feed cassette.

The plane Sa is an example of a plane on which the urging force is applied on the first elastic member 26 and the second elastic member 27.

The third side surface 2405 is an example of a side surface in the second link 24 in which the rib slides.

Hereinafter, certain modifications will be described.

In the description of the above embodiment, an example in which the rib sliding on the side surface of the second link 24 is provided on the second member 22 has been described. However, the rib may be provided only on the first member 21, or may be provided on both the first member 21 and the second member 22.

In an embodiment, the first member 21 is not provided with a rib, but since the first side surface 2403 of the second link 24 is in sliding contact with the first plate surface portion 2101, the first plate surface portion 2101 serves, like the rib, to sandwich the second link 24 and stabilize the posture.

When the posture of the second link 24 can be stabilized only by the second link 24 in sliding contact with the rib Ra, the first plate surface portion 2101 may be separated from the first side surface 2403.

When the ribs are provided on the first member 21, the rib Ra may be omitted as long as the ribs of the first member 21 and the first side surface 2403 can stabilize the posture of the second member 22.

The ribs that slide on the side surface of the second member 22 may be provided on one or both of the first member 21 and the second member 22.

In the description of the above embodiment, the example in which the lubricant holding portion ge is provided at the tip of the rib in the protruding direction has been described.

However, when the sliding friction between the tip of the rib and the side surface of the second link 24 is small, the lubricant holding portion ge may be omitted. For example, when a low friction material is used as the rib material, lubricant and the lubricant holding portion ge may be omitted.

Even when the lubricant holding portion ge is not formed, if lubricant is still required, it can be applied on the tip of the rib or the like.

In the description of the above embodiment, the lubricant holding portion ge is a groove structure, but the lubricant holding portion ge need not necessarily be a groove and, in general, any type or shape of structure may be adopted as long as such shape or structure can hold the lubricant. For example, the tip of the rib may be formed with minute irregularities, streaks, or rough surfaces, or the tip of the rib may be porous.

In the description of the example embodiment(s) above, the cassette drawing-in device 20 includes a third link 25 and a second elastic member 27. However, in other examples, the third link 25 and the second elastic member 27 may be omitted as long as there still is a space for arranging the first elastic member 26 for urging the first link 23. When the third link 25 and the second elastic member 27 are not provided, the end (the second hook 262) of the first elastic member 26 opposite to the end that is locked with the first link 23 can be locked with the second member 22 or the first member 21.

According to at least one embodiment described above, it is possible to provide a cassette drawing-in device permitting the insertion and removal of a paper feed cassette along a first direction. The cassette drawing-in device includes a guide portion that guides a position of a pin that protrudes from the paper feed cassette in a second direction orthogonal to the first direction. The guide portion positions the pin in a third direction that is orthogonal to the first direction and the second direction, when the paper feed cassette is being inserted and removed. The guide portion is formed on a first member. A second member is fixed with the first member and faces the first member in the first direction. A first rotation shaft is provided between the first member and the second member and has a length from the second member to the first member along the first direction. A first link is rotationally supported by the first rotation shaft. A second rotation shaft is provided on the first link and has a length in a direction facing the first member in the first direction. A second link is rotationally supported by the second rotation shaft and includes an engagement groove which can be engaged with the pin in the first direction. The engagement groove permits the second link to slide on the pin in a direction intersecting a moving direction of the pin. A rib, which can be provided on one or both of the first member and the second member, protrudes in the first direction toward the second link and slides on a side surface of the second link in a range of movement of the second link accompanying the rotation of the first link around the first rotation shaft thereby reducing a load on a user and smoothly inserting a paper feed cassette.

While certain exemplary embodiments have been described, these embodiments have been presented by way of example only, and are not intended to limit the scope of the disclosure herein. Indeed, the novel apparatus and methods described herein may be embodied in a variety of other forms; furthermore, various omissions, substitutions and changes in the form of the apparatus and methods described herein may be made without departing from the spirit of the exemplary embodiments disclosed herein. The accompanying claims and their equivalents are intended to cover such forms or modifications as would fall within the scope and spirit of the exemplary embodiments disclosed herein.

What is claimed is:

1. A cassette drawing-in device, comprising:

a first member;

a guide portion formed in the first member and configured to accept a pin that protrudes from a paper feed cassette to be inserted and removed along a first direction, the pin protruding from the paper feed cassette in a second direction orthogonal to the first direction, the guide portion positioning the pin in a third direction orthogonal to the first direction and the second direction when the paper feed cassette is being inserted and removed;

a second member fixed to the first member and facing the first member in the first direction;

a first rotation shaft between the first member and the second member with a length from the second member to the first member in the first direction;

a first link rotationally supported by the first rotation shaft;

a second rotation shaft on the first link with a length in a direction facing the first member in the first direction;

a second link rotationally supported by the second rotation shaft and including an engagement groove which engages with the pin in the first direction and slides on the pin in a direction intersecting a moving direction of the pin; and a rib on at least one of the first member and the second member and protruding in the first direction toward the second link, the rib sliding on a side surface of the second link within a range of movement of the second link accompanying the rotation of the first link around the first rotation shaft.

2. The cassette drawing-in device according to claim 1, further comprising:

a lubricant holding portion for holding a lubricant at a tip of the rib in the protruding direction.

3. The cassette drawing-in device according to claim 1, wherein a shape of the rib when seen from the first direction is an arc shape centered on the first rotation shaft.

4. The cassette drawing-in device according to claim 1, further comprising:

a third rotation shaft with a length from the second member toward the first member in the first direction;

a third link having a first end and a second end, the third link rotationally supported by the third rotation shaft at an intermediate position between the first end and the second end;

a first elastic member locked with the first end of the third link and a first locking portion on the first link, the first elastic member applying a moment of force about the first rotation shaft to the first link; and a second elastic member locked with the second end of the third link and a second locking portion on the second member, the second elastic member applying a moment of force applied about the third rotation shaft to the third link in a direction opposite to the moment of force of the first elastic member, wherein an urging force from the first elastic member and the second elastic member is applied on a plane intersecting the first rotation shaft and the third rotation shaft, and an engagement position between the pin and the engagement groove is separated from the plane in a direction normal to the plane.

5. The cassette drawing-in device according to claim 4, wherein the side surface of the second link that slides on the rib is separated from the plane in the direction normal to the plane.

6. The cassette drawing-in device according to claim 1, further comprising:

a lubricant holding groove in a tip of the rib in the protruding direction.

7. An image processing apparatus, comprising:

a main body housing;

a sheet cassette accommodation section in the main body housing, the sheet cassette accommodation section configured to receive at least one paper feed cassette; and a cassette drawing-in device in the sheet cassette accommodation section and configured to receive a paper feed cassette, the cassette drawing-in device comprising:

a first member;

a guide portion formed in the first member and configured to accept a pin that protrudes from a paper feed cassette to be inserted and removed along a first direction, the pin protruding from the paper feed cassette in a second direction orthogonal to the first direction, the guide portion positioning the pin in a third direction orthogonal to the first direction and the second direction when the paper feed cassette is being inserted and removed;

a second member fixed to the first member and facing the first member in the first direction;

a first rotation shaft between the first member and the second member with a length from the second member to the first member in the first direction;

a first link rotationally supported by the first rotation shaft;

a second rotation shaft on the first link with a length in a direction facing the first member in the first direction;

a second link rotationally supported by the second rotation shaft and including an engagement groove which engages with the pin in the first direction and slides on the pin in a direction intersecting a moving direction of the pin; and a rib on at least one of the first member and the second member and protruding in the first direction toward the second link, the rib sliding on a side surface of the second link within a range of movement of the second link accompanying the rotation of the first link around the first rotation shaft.

8. The image processing apparatus according to claim 7, wherein the cassette drawing-in device further comprises:

a lubricant holding portion for holding a lubricant at a tip of the rib in the protruding direction.

9. The image processing apparatus according to claim 7, wherein a shape of the rib when seen from the first direction is an arc shape centered on the first rotation shaft.

10. The image processing apparatus according to claim 7, wherein the cassette drawing-in device further comprises:

a third rotation shaft with a length from the second member toward the first member in the first direction;

a third link having a first end and a second end, the third link rotationally supported by the third rotation shaft at an intermediate position between the first end and the second end;

a first elastic member locked with the first end of the third link and a first locking portion on the first link, the first elastic member applying a moment of force about the first rotation shaft to the first link; and a second elastic member locked with the second end of the third link and a second locking portion on the second member, the second elastic member applying a moment of force applied about the third rotation shaft to the third link in a direction opposite to the moment of force of the first elastic member, wherein an urging force from the first elastic member and the second elastic member is applied on a plane intersecting the first rotation shaft and the third rotation shaft, and an engagement position between the pin and the engagement groove is separated from the plane in a direction normal to the plane.

11. The image processing apparatus according to claim 10, wherein the side surface of the second link that slides on the rib is separated from the plane in the direction normal to the plane.

12. The image processing apparatus according to claim 7, further comprising:

an image forming unit configured to receive a sheet from the paper feed cassette.

13. The image processing apparatus according to claim 7, wherein the cassette drawing-in device further comprises:

a lubricant holding groove in a tip of the rib in the protruding direction.

14. A multifunctional peripheral apparatus, comprising:

a main body housing;

an image forming unit in the main body housing;

a sheet cassette accommodation section in the main body housing, the sheet cassette accommodation section configured to receive at least one paper feed cassette; and a cassette drawing-in device in the sheet cassette accommodation section and configured to receive a paper feed cassette, the cassette drawing-in device comprising:

a first member;

a guide portion formed in the first member and configured to accept a pin that protrudes from a paper feed cassette to be inserted and removed along a first direction, the pin protruding from the paper feed cassette in a second direction orthogonal to the first direction, the guide portion positioning the pin in a third direction orthogonal to the first direction and the second direction when the paper feed cassette is being inserted and removed;

a second member fixed to the first member and facing the first member in the first direction;

a first rotation shaft between the first member and the second member with a length from the second member to the first member in the first direction;

a first link rotationally supported by the first rotation shaft;

a second rotation shaft on the first link with a length in a direction facing the first member in the first direction;

a second link rotationally supported by the second rotation shaft and including an engagement groove which engages with the pin in the first direction and slides on the pin in a direction intersecting a moving direction of the pin; and a rib on at least one of the first member and the second member and protruding in the first direction toward the second link, the rib sliding on a side surface of the second link within a range of movement of the second link accompanying the rotation of the first link around the first rotation shaft.

15. The multifunctional peripheral apparatus according to claim 14, wherein the cassette drawing-in device further comprises:

a lubricant holding portion for holding a lubricant at a tip of the rib in the protruding direction.

16. The multifunctional peripheral apparatus according to claim 14, wherein a shape of the rib when seen from the first direction is an arc shape centered on the first rotation shaft.

17. The multifunctional peripheral apparatus according to claim 14, wherein the cassette drawing-in device further comprises:

a third rotation shaft with a length from the second member toward the first member in the first direction;

a third link having a first end and a second end, the third link rotationally supported by the third rotation shaft at an intermediate position between the first end and the second end;

a first elastic member locked with the first end of the third link and a first locking portion on the first link, the first elastic member applying a moment of force about the first rotation shaft to the first link; and a second elastic member locked with the second end of the third link and a second locking portion on the second member, the second elastic member applying a moment of force applied about the third rotation shaft to the third link in a direction opposite to the moment of force of the first elastic member, wherein an urging force from the first elastic member and the second elastic member is applied on a plane intersecting the first rotation shaft and the third rotation shaft, and an engagement position between the pin and the engagement groove is separated from the plane in a direction normal to the plane.

18. The multifunctional peripheral apparatus according to claim 17, wherein the side surface of the second link that slides on the rib is separated from the plane in the direction normal to the plane.

19. The multifunctional peripheral apparatus according to claim 14, wherein the cassette drawing-in device further comprises:

a lubricant holding groove in a tip of the rib in the protruding direction.

20. The multifunctional peripheral apparatus according to claim 14, further comprising:

an image reading unit configured to scan a document and provide image data to the image forming unit.

* * * * *